US011176886B2

(12) United States Patent
Yuan et al.

(10) Patent No.: US 11,176,886 B2
(45) Date of Patent: Nov. 16, 2021

(54) PIXEL COMPENSATION CIRCUIT, DRIVING METHOD THEREOF, DISPLAY PANEL, AND DISPLAY DEVICE

(71) Applicant: BOE TECHNOLOGY GROUP CO., LTD., Beijing (CN)

(72) Inventors: Lijun Yuan, Beijing (CN); Mingfu Han, Beijing (CN); Zhichong Wang, Beijing (CN); Haoliang Zheng, Beijing (CN); Seungwoo Han, Beijing (CN); Guangliang Shang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 246 days.

(21) Appl. No.: 16/319,185

(22) PCT Filed: May 14, 2018

(86) PCT No.: PCT/CN2018/086729
§ 371 (c)(1),
(2) Date: Jan. 18, 2019

(87) PCT Pub. No.: WO2019/037476
PCT Pub. Date: Feb. 28, 2019

(65) Prior Publication Data

US 2020/0388217 A1 Dec. 10, 2020

(30) Foreign Application Priority Data

Aug. 24, 2017 (CN) ..... 201710734919.7

(51) Int. Cl.
*G09G 3/3258* (2016.01)
*G09G 3/3266* (2016.01)
(Continued)

(52) U.S. Cl.
CPC ..... *G09G 3/3258* (2013.01); *G09G 3/3208* (2013.01); *G09G 3/3225* (2013.01);
(Continued)

(58) Field of Classification Search
CPC .. G09G 3/3208; G09G 3/3225; G09G 3/3233; G09G 3/3258; G09G 3/3266;
(Continued)

(56) References Cited

U.S. PATENT DOCUMENTS 8,022,920 B2 * 9/2011 Kim ..... G11C 19/28 345/100
2006/0023551 A1 * 2/2006 Peng ..... G09G 3/3233 365/226
(Continued)

FOREIGN PATENT DOCUMENTS

| | | | |
|---|---|---|---|
| CN | 104485066 | A | 4/2015 |
| CN | 104835452 | A | 8/2015 |
| CN | 105185305 | A | 12/2015 |
| CN | 107331351 | A | 11/2017 |
| CN | 207337880 | U | 5/2018 |

OTHER PUBLICATIONS

International Search Report and Written Opinion for PCT/CN2018/086729 dated Aug. 1, 2018.

*Primary Examiner* — Jason M Mandeville
(74) *Attorney, Agent, or Firm* — The Webb Law Firm

(57) ABSTRACT

The present disclosure discloses a circuit, a driving method thereof, a display panel and a display device. The circuit may include: a signal control module, a compensation control module, an initialization module, a data writing module, a driving control module, and a light emitting device. With the signal control module which is cooperated with other modules, the threshold voltage compensation time of the driving transistor can be increased, and the threshold voltage compensation can be ensured, thereby improving the image display quality.

17 Claims, 16 Drawing Sheets

(51) Int. Cl.
*G09G 3/3275* (2016.01)
*G09G 3/3233* (2016.01)
*G09G 3/3208* (2016.01)
*G09G 3/3225* (2016.01)

(52) U.S. Cl.
CPC ..... *G09G 3/3233* (2013.01); *G09G 3/3266* (2013.01); *G09G 3/3275* (2013.01); *G09G 2300/0814* (2013.01); *G09G 2310/0286* (2013.01)

(58) Field of Classification Search
CPC .. G09G 3/3275; G09G 3/3283; G09G 3/3291; G09G 2300/0814; G09G 2310/0286
USPC ..... 345/204, 76
See application file for complete search history.

(56) References Cited

U.S. PATENT DOCUMENTS

| | | | | |
|---|---|---|---|---|
| 2006/0248421 | A1 | 11/2006 | Choi | |
| 2007/0124633 | A1* | 5/2007 | Kim | G09G 3/3266 714/726 |
| 2007/0262931 | A1 | 11/2007 | Peng et al. | |
| 2011/0193855 | A1 | 8/2011 | Han | |
| 2014/0022150 | A1 | 1/2014 | Guo et al. | |
| 2015/0124005 | A1* | 5/2015 | Wang | G09G 3/3233 345/690 |
| 2015/0269890 | A1 | 9/2015 | Ma | |
| 2016/0275869 | A1 | 9/2016 | Hwang et al. | |

* cited by examiner

PIXEL COMPENSATION CIRCUIT, DRIVING METHOD THEREOF, DISPLAY PANEL, AND DISPLAY DEVICE

CROSS REFERENCE TO RELATED APPLICATIONS

This application is a national stage of International Application No. PCT/CN2018/086729, filed on May 14, 2018, which claims priority to Chinese Patent Application No. 201710734919.7, filed on Aug. 24, 2017. Both of the aforementioned applications are hereby incorporated by reference in their entireties.

FIELD

The present disclosure relates to the field of display technologies, and in particular, to a pixel compensation circuit, a driving method thereof, a display panel, and a display device.

BACKGROUND

Organic Light Emitting Diode (OLED) display panel is one of the hotspots in the research of flat panel display panels. Compared with liquid crystal display (LCD) panels, OLED display panels have several advantages, such as, low energy consumption, low production cost, self-illumination, wide viewing angle, and fast response. At present, in the display fields of mobile phones, tablet computers, digital cameras, etc., OLED display panels have begun to replace traditional LCD display panels. Generally, in an OLED display panel, a pixel compensation circuit capable of compensating for a threshold voltage of a driving transistor is used to drive the OLED to emit light, so as to make the OLED display panel emit lights uniformly.

However, with the continuous development of display technology, the refresh frequency of the OLED display panel is also getting higher and higher. For the same size OLED display panels, the higher the refresh frequency of the OLED display panel is, the shorter the time for scanning one frame of image is, thus the duration for scanning a line of pixels is shortened. Therefore, the pixel compensation circuit lacks time for compensating for the threshold voltage of the driving transistor, resulting in poor compensation effect, thereby affecting the display effect of the entire image.

SUMMARY

Embodiments of the present disclosure provide a pixel compensation circuit, a driving method thereof, a display panel, and a display device for improving the compensation time of the threshold voltage of the driving transistor, improving the compensation effect, and improving the image display performance.

According to some embodiments of the present disclosure, there is provided a circuit comprising:

a light emitting device;

a data writing module (4) having a control terminal connected to a first signal terminal, an input terminal connected to a data signal terminal, and an output terminal connected to a first node (A), wherein the data writing module is configured to provide a signal at the data signal terminal to the first node under control of a signal at the first signal terminal;

a signal control module (1) having a first input terminal connected to the first signal terminal, second input terminal(s) respectively connected to second signal terminal(s), and an output terminal connected to a second node (B); wherein the signal control module is configured to provide a control signal to the second node based on the signal at the first signal terminal and signal(s) at the respective second signal terminal(s);

a compensation control module (2) having a control terminal connected to the second node, an input terminal connected to a third node (C), and an output terminal connected to a fourth node (D); wherein the compensation control module is configured to connect the third node and the fourth node under control of the signal at the second node;

an initialization module (3) having a control terminal connected to a reset signal terminal, an input terminal connected to an initialization signal terminal, and an output terminal connected to the fourth node (D); wherein the initialization module is configured to provide a signal at the initialization signal terminal to the fourth node under control of a signal of the reset signal terminal; and a drive control module (7) having a control terminal connected to the fourth node, an input terminal connected to the first node, and an output terminal connected to the third node; wherein the drive control module is configured to connect the first node and the third node under control of signals at the first node and the fourth node, to drive the light emitting device.

In an embodiment, the circuit further comprises: a storage module (6) connected between the fourth node and a first power terminal, for storing charges therein.

In an embodiment, the circuit further comprises: a light emission control module (5) having a control terminal connected to a light-emission control signal terminal, a first input terminal connected to a first power terminal, a second input terminal connected to the third node, a first output terminal connected to the first node, and a second output terminal connected to a first end of the light emitting device, a second end of the light emitting device being connected to a second power terminal; wherein the light emission control module is configured to allow the drive control module to drive the light emitting device to emit light, under control of a signal at the light-emission control signal terminal.

According to some embodiments of the present disclosure, there is provided circuit comprising:

a signal control module, a compensation control module, an initialization module, a data writing module, a storage module, a drive control module, and a light emitting device, wherein the data writing module has a control terminal connected to a scan signal terminal, an input terminal connected to a data signal terminal, and an output terminal connected to a first node; and the data writing module is configured to provide a signal at the data signal terminal to the first node under control of the scan signal terminal;

wherein the signal control module has a first input terminal connected to the scan signal terminal, M second input terminals respectively connected to M holding control signal terminals, and an output terminal connected to a second node; and the signal control module is configured to provide a control signal to the second node according to a signal at the scan signal terminal and signals at the holding control signal terminals; and wherein M is a positive integer;

wherein the compensation control module has a control terminal connected to the second node, an input terminal connected to a third node, and an output terminal connected to a fourth node; and the compensation control module is configured to connect the third node and the fourth node under control of a signal at the second node;

wherein the initialization module has a control terminal connected to a reset signal terminal, an input terminal connected to an initialization signal terminal, and an output terminal connected to the fourth node; and the initialization module is configured to provide a signal at the initialization signal terminal to the fourth node under control of a signal of the reset signal terminal;

wherein the drive control module has a control terminal connected to the fourth node, an input terminal connected to the first node, and an output terminal connected to the third node; and the drive control module is configured to connect the first node and the third node, under control of signals at the first node and the fourth node, to drive the light emitting device; and wherein the storage module is connected between the fourth node and a first power terminal for maintaining a voltage at the fourth node stable.

In an embodiment, the circuit further comprises:

a light emission control module having a control terminal connected to a light-emission control signal terminal, a first input terminal connected to the first power terminal, a second input terminal connected to the third node, a first output terminal connected to the first node, and a second output terminal connected to a first end of the light emitting device, a second end of the light emitting device being connected to a second power terminal;

wherein the light emission control module is configured to allow the drive control module to drive the light emitting device to emit light, under control of the light-emission control signal terminal.

In an embodiment, the signal control module comprises:

a first AND gate having M+1 input terminals;

wherein each of the first to the M-th input terminals of the first AND gate is connected to one of the holding control signal terminals, and the (M+1)th input terminal of the first AND gate is connected to the scan signal terminal, and wherein an output terminal of the first AND gate is connected to the second node.

In an embodiment, the signal control module comprises: a first inverter; and a second AND gate having M+1 input terminals, wherein each of the first to the M-th input terminals of the second AND gate is connected to one of the holding control signal terminals, and the (M+1)th input terminal of the second AND gate is connected to the scan signal terminal, and an output terminal of the second AND gate is connected to an input terminal of the first inverter; and wherein an output terminal of the first inverter is connected to the second node.

In an embodiment, the signal control module comprises: a first OR gate having M+1 input terminals, wherein each of the first to the M-th input terminals of the first OR gate is connected to one of the holding control signal terminals, and the (M+1)th input terminal of the first OR gate is connected to the scan signal terminal, and wherein an output terminal of the first OR gate is connected to the second node.

In an embodiment, the signal control module comprises: a second inverter; and a second OR gate having M+1 input terminals, wherein each of the first to the M-th input terminals of the second OR gate is connected to one of the holding control signal terminals, and the (M+1)th input terminal of the second OR gate is connected to the scan signal terminal, and an output terminal of the second OR gate is connected to an input terminal of the second inverter; and wherein an output terminal of the second inverter is connected to the second node.

In an embodiment, the compensation control module comprises: a first switching transistor, wherein a control electrode of the first switching transistor is connected to the second node, a first pole of the first switching transistor is connected to the third node, and a second pole of the first switching transistor is connected to the fourth node.

In an embodiment, the initialization module comprises: a second switching transistor, wherein a control electrode of the second switching transistor is connected to the reset signal terminal, a first pole of the second switching transistor is connected to the initialization signal terminal, and a second pole of the second switching transistor is connected to the fourth node; and the data writing module includes: a third switching transistor, wherein a control electrode of the third switching transistor is connected to the scan signal terminal, a first pole of the third switching transistor is connected to the data signal terminal, and a second pole of the third switching transistor is connected to the first node.

In an embodiment, the light emission control module comprises: a fourth switching transistor and a fifth switching transistor, wherein a control electrode of the fourth switching transistor is connected to the light-emission control signal terminal, a first pole of the fourth switching transistor is connected to the first power terminal, a second pole of the fourth switching transistor is connected to the first node; and wherein a control electrode of the fifth switching transistor is connected to the light emitting control signal terminal, a first pole of the fifth switching transistor is connected to the third node, and a second pole of the fifth switching transistor is connected to the first end of the light emitting device.

In an embodiment, the drive control module comprises: a drive transistor, wherein a control electrode of the drive transistor is connected to the fourth node, a first pole of the drive transistor is connected to the first node, and a second pole of the driving transistor is connected to the third node; and the storage module includes: a storage capacitor, wherein a first end of the storage capacitor is connected to the fourth node, and a second end of the storage capacitor is connected to the first power terminal.

In an embodiment, the circuit further comprises: an anode reset module having a control terminal connected to the reset signal terminal, an input terminal connected to the initialization signal terminal, and an output terminal connected to the first end of the light emitting device, wherein the anode reset module is configured to reset the first end of the light emitting device under control of the reset signal terminal.

In an embodiment, the anode reset module comprises: a sixth switching transistor, wherein a control electrode of the sixth switching transistor is connected to the reset signal terminal, a first pole of the sixth switching transistor is connected to the initialization signal terminal, and a second pole of the sixth switching transistor is connected to the first end of the light emitting device.

According to some embodiments of the present disclosure, there is provided a display panel comprising the circuit of any of the embodiments.

In an embodiment, the display panel further comprises: a gate driving circuit comprising (K+M) stages of shift registers which are cascaded; wherein K is a total number of lines of pixels in the display panel, wherein the scan signal terminal of the circuit in the k-th line is connected to the signal output terminal of the k-th stage shift register, and each of the holding control signal terminals of the circuit in the k-th line is connected to respective one of the signal output terminals of the (k+1)th to (k+M)th stages of shift registers in one-to-one manner; wherein k is an integer greater than or equal to 1 and less than or equal to K.

According to some embodiments of the present disclosure, there is provided a display device comprising the display panel of any of the embodiments.

According to some embodiments of the present disclosure, there is provided a method of driving a circuit of any of the embodiments, comprising: an initialization phase, a data writing phase, a compensation holding phase, and a light emitting phase, wherein the compensation holding phase comprises compensation holding sub-phase(s) corresponding to the respective holding control signal terminal(s) in one-to-one manner; wherein:

in the initialization phase, a first potential signal is provided to the reset signal terminal, and a second potential signal is respectively provided to the scan signal terminal, the holding control signal terminal(s), and the light-emission control signal terminal;

in the data writing phase, a first potential signal is provided to the scan signal terminal, and a second potential signal is respectively provided to the reset signal terminal, the holding control signal terminal(s), and the light-emission control signal terminal;

in the compensation holding phase, for each of the compensation holding sub-phase(s), a first potential signal is supplied to the holding control signal terminal corresponding to the compensation holding sub-stage, and a second potential signal is respectively provided to the other holding control signal terminal(s) than the one corresponding to the compensation holding sub-phase, the reset signal terminal, the scan signal terminal, and the light-emission control signal terminal; and in the light emitting phase, a first potential signal is provided to the light-emission control signal terminal, and a second potential signal is respectively provided to the reset signal terminal, the scan signal terminal, and the holding control signal terminal(s).

According to the embodiment of the present disclosure, the time for threshold voltage compensation of the driving transistor can be increased, the threshold voltage compensation can be more fully, and the display quality of the image can be improved, in particular, the pixel compensation circuit provided by the embodiment of the present disclosure is applied to the refresh frequency. When in the high display panel.

DETAILED DESCRIPTION OF ILLUSTRATIVE EMBODIMENTS

The specific embodiments of the pixel compensation circuit, the driving method thereof, the display panel, and the display device according to the embodiments of the present disclosure are described in detail below with reference to the accompanying drawings. It is to be noted that the preferred embodiments described below are intended for illustrative and descriptive purpose only to illustrate the present disclosure and are not intended to limit the present disclosure. And, the embodiments in the present application and the features in the embodiments can be combined with each other when appropriate.

Figure 1A:
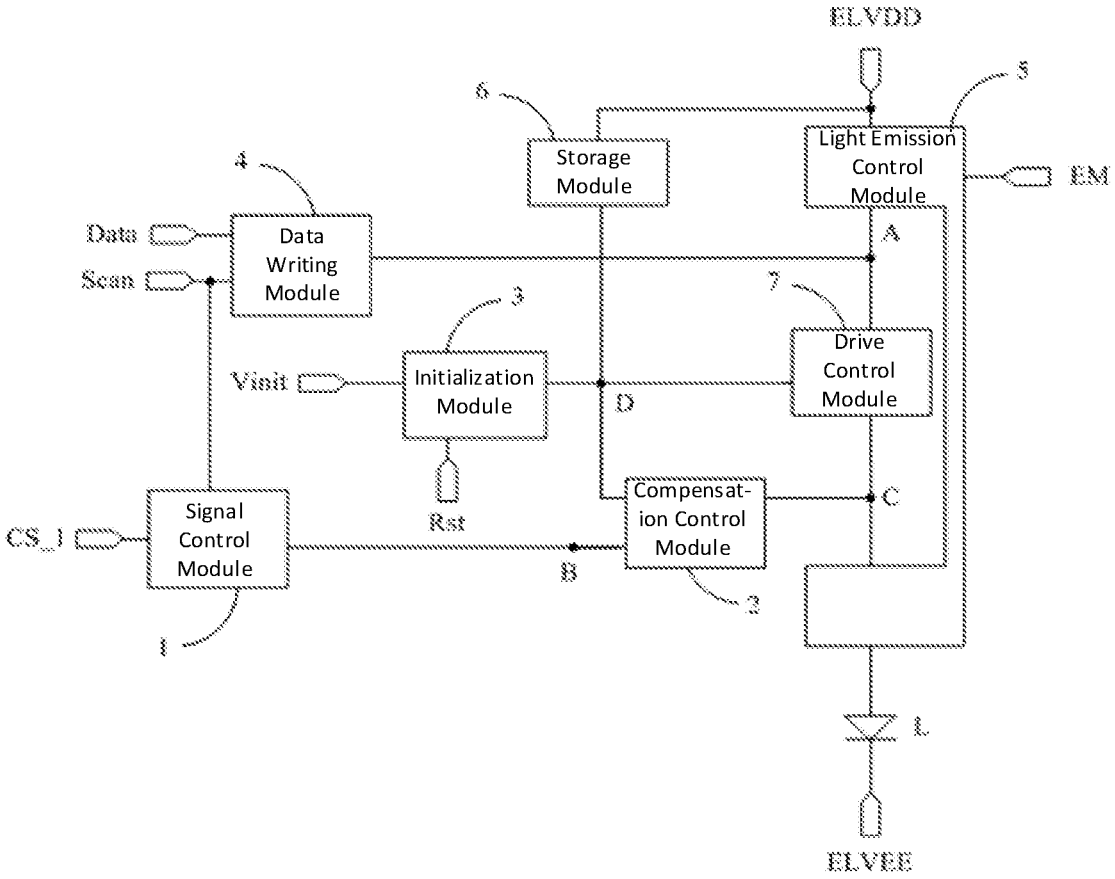
FIG. 1*a* is a schematic structural diagram of a pixel compensation circuit according to an embodiment of the present disclosure.

Embodiments of the present disclosure provide a circuit which can be used for pixel compensation. Therefore, in the following, the circuit is sometimes referred to as pixel compensation circuit. As shown in FIG. 1*a*, the circuit may include: a signal control module 1, a compensation control module 2, an initialization module 3, a data writing module 4, a storage module 6, a drive control module 7, and a light emitting device L. In some embodiments, the circuit can also include a light emission control module 5. The data writing module 4 has a control terminal connected to a scan signal terminal Scan, an input terminal connected to a data signal terminal Data, an output terminal connected to a first node A. The data writing module 4 is configured for providing the signal at the data signal terminal Data to the first node A under control of the signal at the scan signal terminal Scan.

The signal control module 1 has a first input terminal connected to the scan signal terminal Scan, second input terminals respectively connected to M holding control signal terminals CS_m (m=1, 2, 3, . . . , M) in one-to-one manner, and an output terminal connected to a second node B. The signal control module is configured to provide a control signal to the second node according to the signal at the scan signal terminal and the signals at the respective holding control signal terminals. For example, the signal of the scan signal terminal Scan and the signals of the respective holding control signal terminals CS are combined by the signal control module 1 and provided the second node B. M is a positive integer. In FIG. 1*a*, the case in which M=1 is shown as an example. In FIG. 1*c*, a case where the signal control module receives a plurality of (M) holding control signal terminals CS_1 to CS_M) is shown as an example.

The compensation control module 2 has a control terminal connected to the second node B, an input terminal connected to a third node C, and an output terminal connected to a fourth node D. The compensation control module 2 is configured to connect the third node C and the fourth node D under control of the signal at/of the second node B.

The initialization module 3 has a control terminal connected to a reset signal terminal Rst, an input terminal connected to an initialization signal terminal Vinit, and an output terminal connected to the fourth node D. The initialization module 3 is configured to provide a signal at the initialization signal terminal Vinit to the fourth node D under control of the signal at the reset signal terminal Rst.

The drive control module 7 has a control terminal connected to the fourth node D, an input terminal connected to the first node A, and an output terminal connected to the third node C. The drive control module 7 is configured to be turned on under control of the signals at the first node A and the fourth node D.

The storage module 6 is coupled between the fourth node D and a first power terminal ELVDD for maintaining the voltage at the fourth node D stable. In some embodiments, the capacitance of the transistor (e.g., gate capacitance) connected to the fourth node D can be utilized to provide a feedback to stabilize the voltage; in such a case, the storage module 6 can be omitted.

The light emission control module 5 has a control terminal connected to a light-emission control signal terminal EM, a first input terminal connected to the first power terminal ELVDD, a second input terminal connected to the third node C, a first output terminal connected to the first node A, and a second output terminal connected to a first end of the light emitting device L. And, a second end of the light emitting device L is connected to a second power terminal ELVSS. The light emission control module 5 is configured to cause the drive control module 7 to drive the light emitting device L to emit light, under control of the signal of the light-emission control signal terminal EM.

According to some embodiments of the present disclosure, there is also provided a circuit which may include: a signal control module 1, a compensation control module 2, an initialization module 3, a data writing module 4, a drive control module 7, and a light emitting device.

The data writing module (4) has a control terminal connected to a first signal terminal, an input terminal connected to a data signal terminal, and an output terminal connected to the first node (A). The data writing module is configured to provide the signal at/of the data signal terminal to the first node under control of a signal at the first signal terminal.

A first input terminal of the signal control module (1) is connected to the first signal terminal, a second input terminal thereof is connected to a second signal terminal, and an output terminal thereof is connected to the second node (B). The signal control module is configured to provide a control signal to the second node based on a signal of the first signal terminal and signals of the respective second signal terminals.

A control terminal of the compensation control module (2) is connected to the second node, an input terminal thereof is connected to a third node (C), and an output terminal thereof is connected to a fourth node (D). The compensation control module is configured to connect the third node and the fourth node under control of the signal of the second node.

A control terminal of the initialization module (3) is connected to a reset signal terminal, an input terminal thereof is connected to an initialization signal terminal, and an output terminal thereof is connected to the fourth node (D). The initialization module is configured to provide the signal of the initialization signal terminal to the fourth node under control of the signal of the reset signal terminal.

A control terminal of the drive control module (7) is connected to the fourth node, an input terminal thereof is connected to the first node, and an output terminal is connected to the third node. The driving control module is configured to connect the first node and the third node under control of the signals of the first node and the fourth node, to drive the light emitting device.

In some embodiments, the circuit may further include a storage module (6) connected between the fourth node and a first power terminal, for store charges therein. The storage module can be used to maintain the voltage at the fourth node D stable.

In some embodiments, the circuit may further include: a light emission control module (5) having a control terminal connected to the light-emission control signal terminal, a first input terminal connected to the first power terminal, a second input terminal connected to the third node, a first output terminal connected to the first node, and a second output terminal connected to a first end of the light emitting device. And a second end of the light emitting device is connected to a second power terminal. The light emission control module is configured to allow the drive control module to drive the light emitting device to emit light, under control of the signal of the light-emission control signal terminal.

According to the embodiments of the present disclosure, a signal control module is provided and cooperates with other modules. According to the embodiments of the present disclosure, the threshold voltage compensation time of the driving transistor can be increased, the threshold voltage can be sufficiently compensated, and the image display quality can be improved, especially when applied to a display panel with a high refresh rate.

In the circuits according to the embodiments of the present disclosure, in a specific implementation, the light emitting device may be a light emitting diode, for example, an organic light emitting diode; or the light emitting device may be a quantum dot light emitting diode. The present disclosure is not limited thereto; in practical applications, the specific structure of the light emitting device can be designed and determined according to the actual application environment.

In the pixel compensation circuits according to the embodiments of the present disclosure, in a specific implementation, the voltage of the signal at/of the first power terminal is generally a high voltage, and the voltage of the signal at/of the second power terminal is generally a low voltage or ground. The disclosure is not limited thereto; in practical applications, the voltages of the signals of the first power terminal and the second power terminal can be determined according to the actual application environment.

Figure 1B:
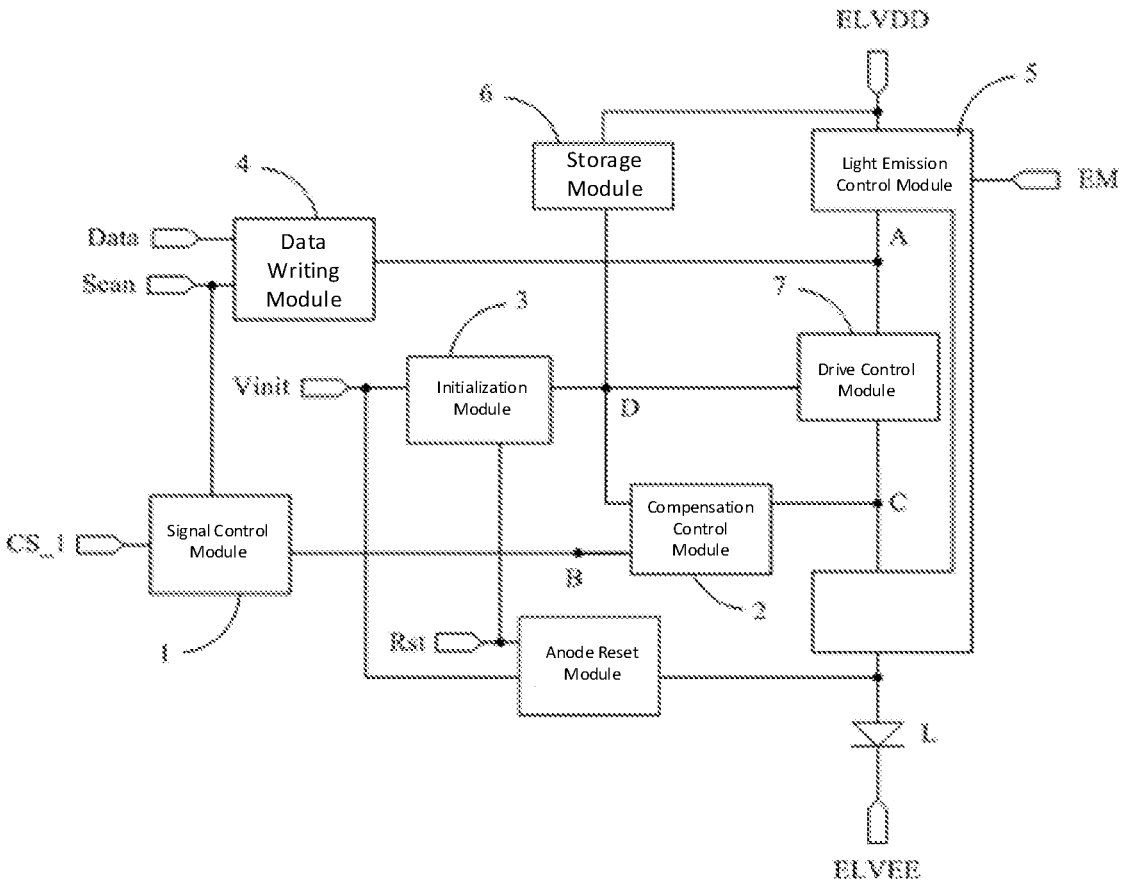
FIG. 1*b* is another schematic structural diagram of a pixel compensation circuit according to an embodiment of the present disclosure.
Figure 1C:
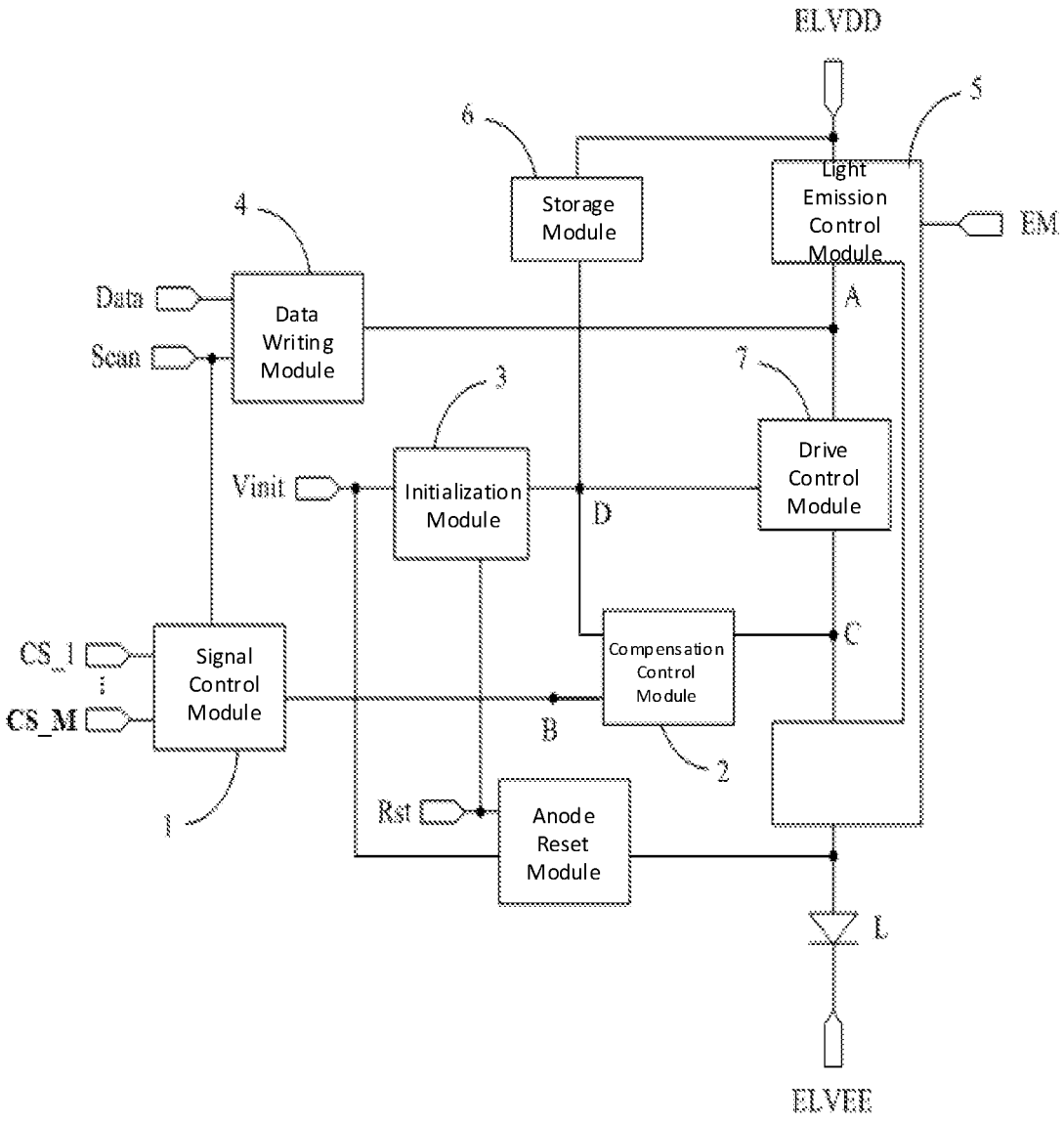
FIG. 1*c* is a schematic structural diagram of a circuit according to another embodiment of the present disclosure.

In some embodiments of the circuit according to the embodiments of the present disclosure, as shown in FIG. 1*b*, the circuit may further include an anode reset module 8 in order to avoid interference of light-emitting between two adjacent frames. A control terminal of the anode reset module 8 is connected to the reset signal terminal Rst, an input terminal thereof is connected to the initialization signal terminal Vinit, and an output terminal thereof is connected to the first end of the light emitting device L. The anode reset module 8 is configured for resetting the first end of the light emitting device L under control of the signal of the reset signal terminal Rst.

FIG. 1*c* is a schematic structural diagram of a circuit according to another embodiment of the present disclosure. The structure of the circuit shown in FIG. 1*c* is substantially the same as that shown in FIG. 1*b*, except that in FIG. 1*c*, the signal control module receives a plurality of (M) holding control signal terminals CS_1 to CS_M). The contents described with respect to FIGS. 1*a* and 1*b* can also be applied likewise or adaptively to the embodiment shown in FIG. 1*c*.

The present disclosure will be described in more detail below with reference to specific embodiments. It should be noted that the present disclosure is intended to explain the present disclosure and not to limit the present disclosure.

Figure 2A:
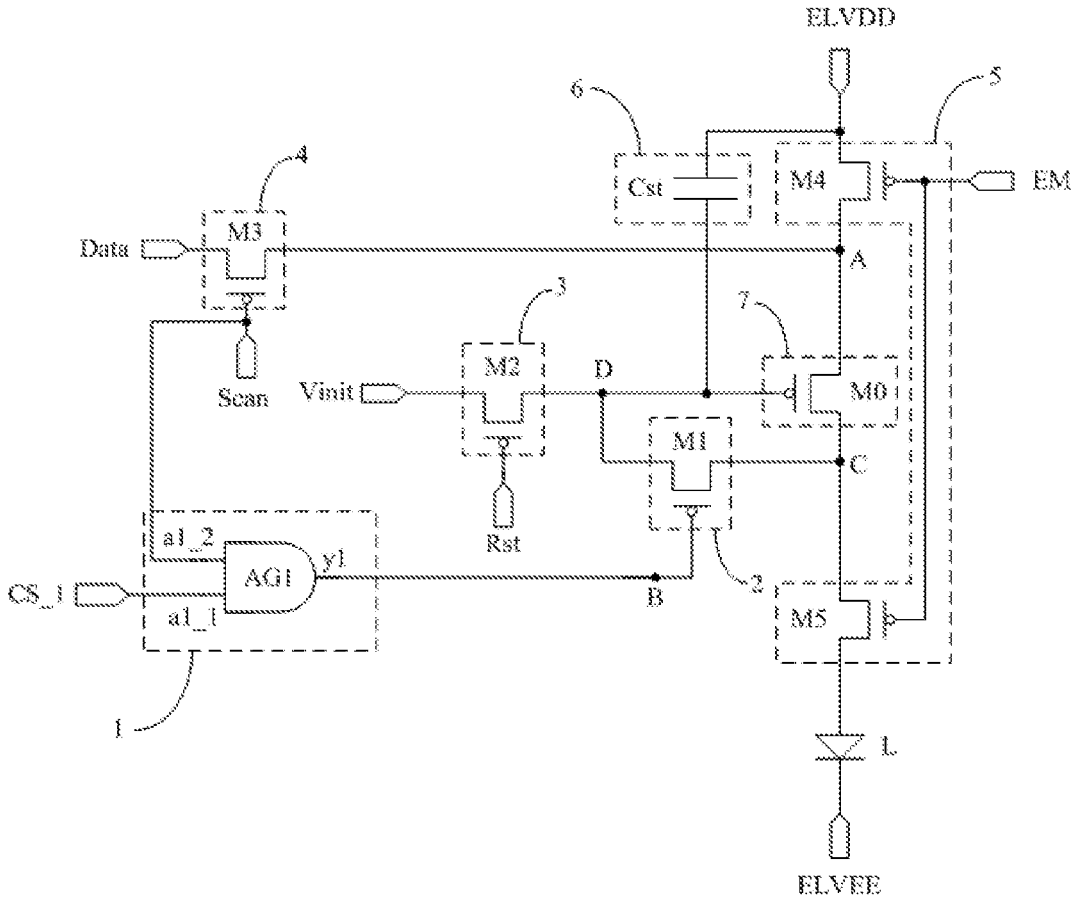
FIG. 2*a* is a schematic diagram of a specific structure of the pixel compensation circuit shown in FIG. 1*a;*
Figure 3A:
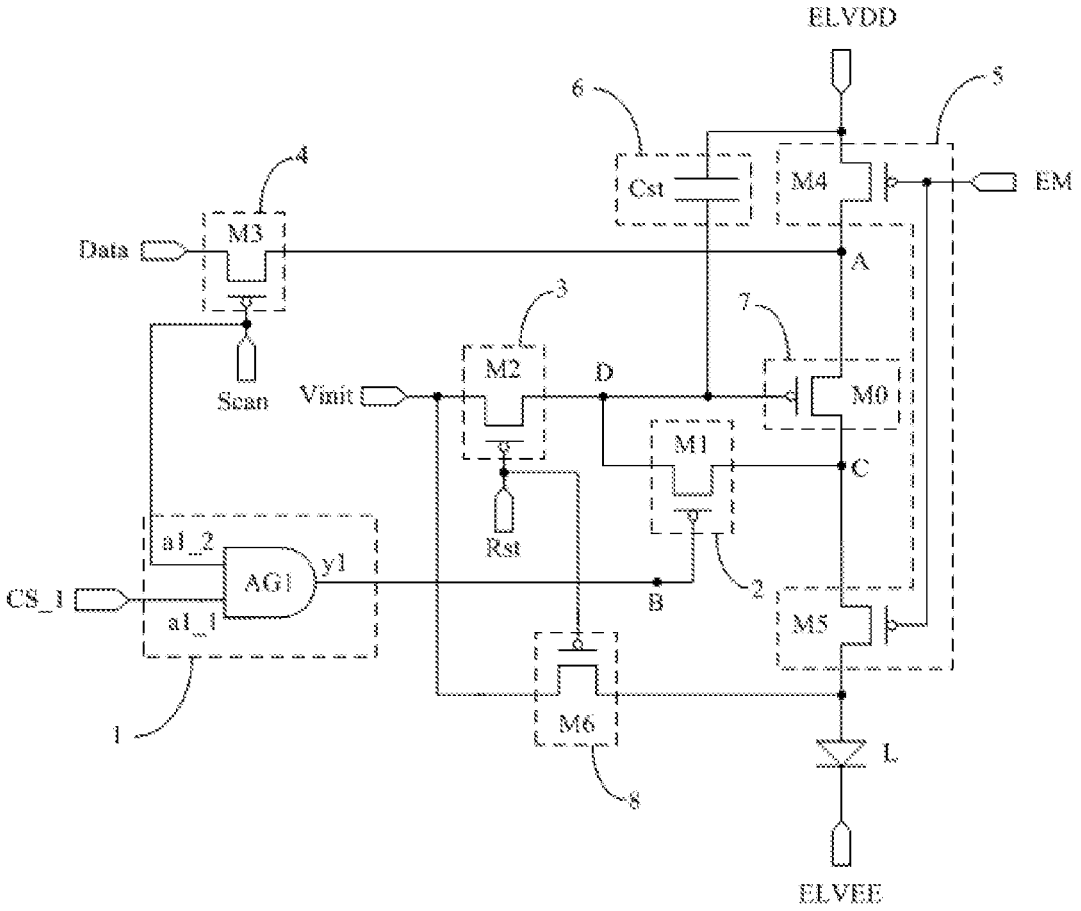
FIG. 3*a* is a schematic diagram of a specific structure of the pixel compensation circuit shown in FIG. 1*b;*

In some specific implementations, in the pixel compensation circuit according to the embodiments of the present disclosure, as shown in FIG. 2*a* and FIG. 3*a* (which exemplarily illustrate the cases where M=1), the signal control module 1 may include: a first AND gate AG1 having M+1 inputs a1_*n* (n=1, 2, 3, . . . , M+1).

Each of the first to the M-th input terminals a1_1~a1_M of the first AND gate AG1 is connected to a holding control signal terminal CS_m, and the (M+1)th input terminal a1_M+1 of the first AND gate AG1 is connected to the scan signal terminal Scan. The output terminal y1 of the first AND gate AG1 is connected to the second node B.

In some specific implementations, in the pixel compensation circuit according to the embodiments of the present disclosure, the first AND gate only outputs high output signals at the output terminal thereof when the signals at the first to the (M+1)th input terminals thereof are high potential signals. As long as the signal at one of the input terminals the first to (M+1)th is a low potential signal, a low potential signal is output at the output terminal.

In some specific implementations, in the pixel compensation circuit according to the embodiments of the present disclosure, as shown in FIG. 2*a* and FIG. 3*a*, M=1, that is, there is one holding control signal terminal CS_1, and the first AND gate AG1 is an AND gate with two inputs a1_1 and a1_2. Alternatively, it is possible to make M=2, that is, there are two holding control signal terminals, and then the first AND gate is an AND gate having three inputs. It is also possible to make M=3, that is, there are three holding control signal terminals, and then the first AND gate is an AND gate having four inputs. And so on when M=4, 5, 6 . . . ; and it will not be repeatedly described here.

Figure 5:
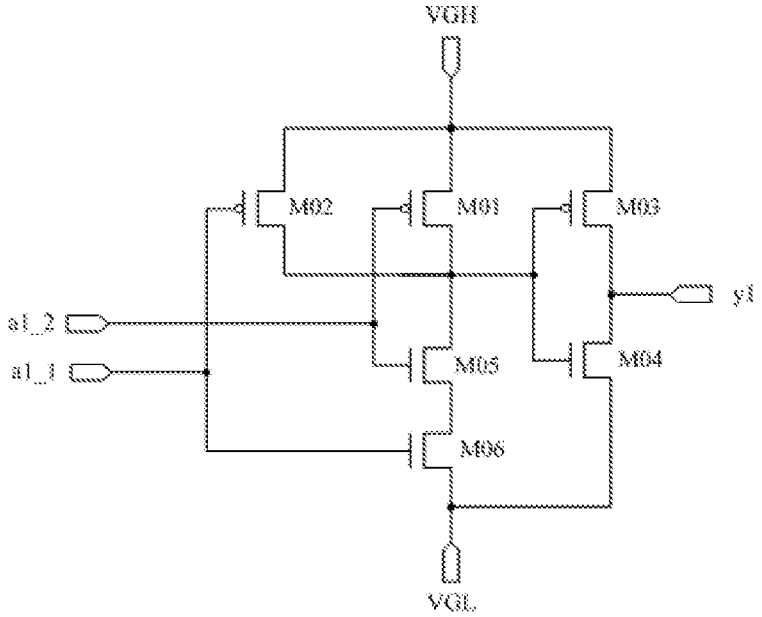
FIG. 5 is a schematic structural diagram of a first AND gate according to an embodiment of the present disclosure.

In some specific implementations, in the pixel compensation circuit according to the embodiments of the present disclosure, when the first AND gate has two inputs, as shown in FIG. 5, the first AND gate may include: a first transistor M01, a second transistor M02, a third transistor M03, a fourth transistor M04, a fifth transistor M05, and a sixth transistor M06.

The control electrode of the first transistor M01 serves as a second input terminal a1_2 of the first AND gate, the first pole of the first transistor M01 is connected to a high voltage reference signal terminal VGH, and the second pole of the first transistor M01 is respectively connected to a second pole of the second transistor M02, the control electrode of the third transistor M03, the control electrode of the fourth transistor M04, and the second pole of the fifth transistor M05.

The control electrode of the second transistor M02 serves as the first input terminal a1_1 of the first AND gate, and the first pole of the second transistor M02 is connected to the high voltage reference signal terminal VGH.

The first pole of the third transistor M03 is connected to the high voltage reference signal terminal VGH, and the second pole of the third transistor M03 serves as the output terminal y1 of the first AND gate.

The first pole of the fourth transistor M04 is connected to a low voltage reference signal terminal VGL, and the second pole of the fourth transistor M04 is connected to the second pole of the third transistor M03.

The control electrode of the fifth transistor M05 is connected to the control electrode of the first transistor M01, and the first pole of the fifth transistor M05 is connected to the second pole of the sixth transistor M06.

The control electrode of the sixth transistor M06 is connected to the control electrode of the second transistor M02, and the first pole of the sixth transistor M06 is connected to the low voltage reference signal terminal VGL.

The above is merely illustrative of a structure of the first AND gate having two inputs, and the present disclosure is not limited thereto. In some specific implementations, the specific structure of the first AND gate is not limited to the above-described structure according to the embodiments of the present disclosure, and may be other structures known to those skilled in the art; and the disclosure is not limited thereto. Moreover, in practical applications, the specific structure of the first AND gate can be determined according to the specific application environment, and the disclosure is not limited thereto. And, for the specific structure of the first AND gate structures known in the prior art or developed in the future can also be employed, and will not be described herein in detail.

In order to simplify the process and design, the scan signal of the next row may be used as the signal at the holding control signal terminal. In some specific implementations, in the pixel compensation circuit according to the embodiments of the present disclosure, the M holding control signal terminals are defined as the first to the M-th holding control signal terminals, the signal of the m-th holding control signal terminal is a signal when the signal of the scan signal terminal corresponding to the row which the pixel compensation circuit is located in is shifted by m rows. Specifically, when M=1, the signal of the first holding control signal terminal is a signal when the signal of the scan signal terminal corresponding to the row, in which the pixel compensation circuit is located, is shifted by one line (row). Alternatively, when M=2, the signal of the first holding control signal terminal is a signal when the signal of the scan signal terminal corresponding to the row, in which the pixel compensation circuit is located, is shifted by one line, and the signal of the second holding control signal terminal is a signal when the signal at the scan signal terminal corresponding to the row, in which the pixel compensation circuit is located, is shifted by 2 lines. Alternatively, when M=3, the signal of the first holding control signal terminal is a signal when the signal of the scan signal terminal corresponding to the row, in which the pixel compensation circuit is located, is shifted by one line, and the signal of the second holding control signal terminal is a signal when the signal at the scan signal terminal corresponding to the row, in which the pixel compensation circuit is located, is shifted by 2 lines, and the signal at the 3rd holding control signal terminal is a signal when the signal of the scan signal terminal corresponding to the row, in which the pixel compensation circuit is located, is shifted by 3 lines. And so on when M=4, 5, 6 . . . , it will not be repeatedly described here.

Figure 2B:
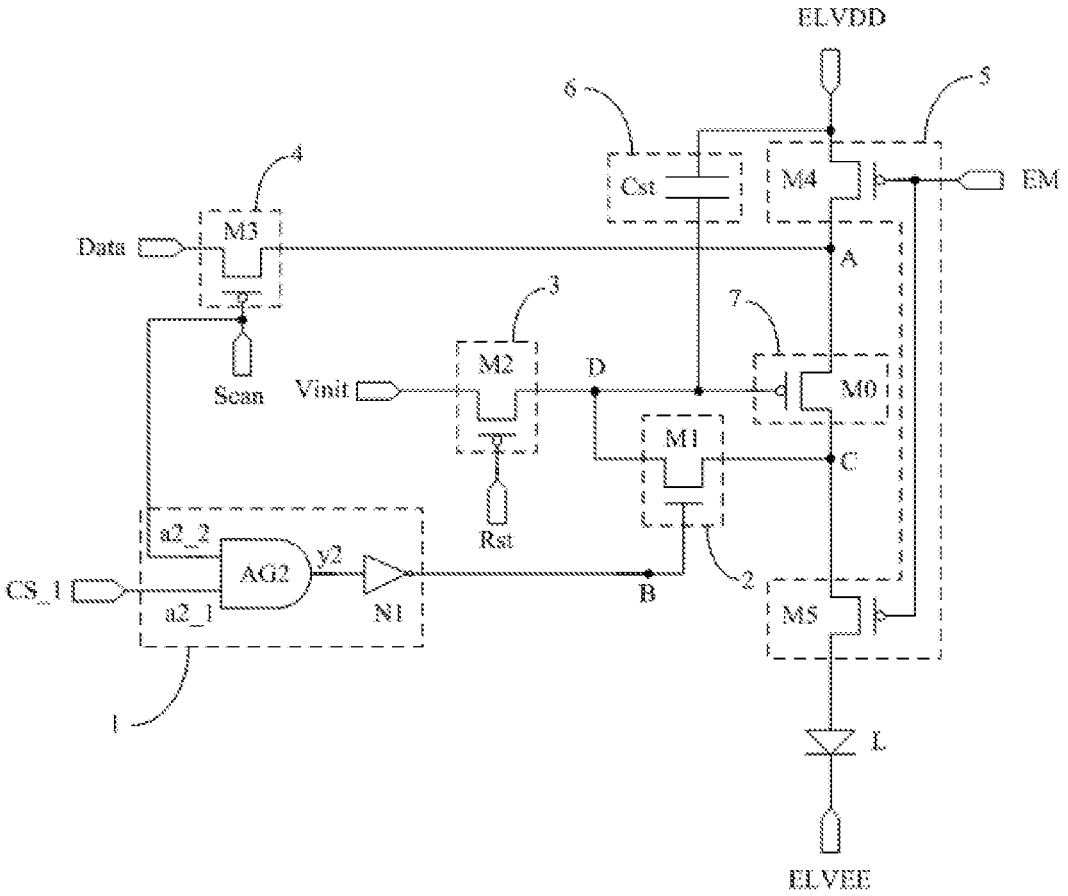
FIG. 2*b* is another schematic diagram of a specific structure of the pixel compensation circuit shown in FIG. 1*a;*
Figure 3B:
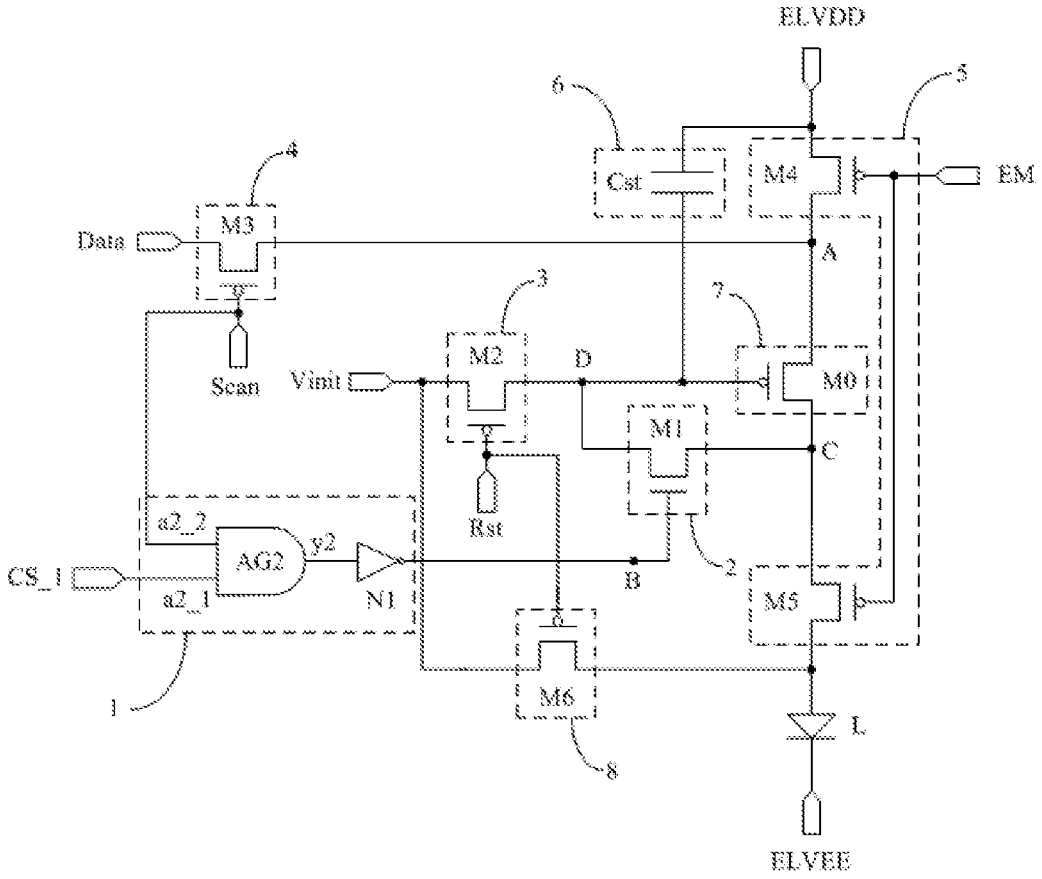
FIG. 3*b* is another schematic structural diagram of the pixel compensation circuit shown in FIG. 1*b;*

Alternatively, in some specific implementations in the pixel compensation circuit according to the embodiments of the present disclosure, as shown in FIG. 2*b* and FIG. 3*b* (FIG. 2*b* and FIG. 3*b* are both exemplified with M=1), the signal control module 1 may include: a first inverter N1, and a second AND gate AG2 having M+1 inputs a2_*n* (n=1, 2, 3, . . . , M+1).

Each of the first to the M-th inputs a2_1 to a2_M of the second AND gate AG2 is connected to a holding control signal terminal CS_m, and the (M+1)th input terminal a2_M+1 of the second AND gate AG2 is connected to the scan signal terminal Scan, and the second output terminal y2 of the AND gate AG2 is connected to the input terminal of the first inverter N1.

The output of the first inverter N1 is connected to the second node B.

In some specific implementations, in the pixel compensation circuit according to the embodiments of the present disclosure, the second AND gate outputs high potential signal only when the signals of the first to the (M+1)th input terminals are high potential signals. As long as the signal at one of the input terminals 1 to M+1 is a low potential signal, the output terminal outputs a low potential signal. The first inverter is used to achieve that the potential of the signal at its output is reverse to the potential of the signal at its input.

In some specific implementations, in the pixel compensation circuit according to the embodiments of the present disclosure, as shown in FIG. 2*b* and FIG. 3*b*, it is possible to make M=1, that is, there is one holding control signal terminal CS_1, and the second AND gate AG1 is an AND gate having two input terminals a2_1 and a2_2. Alternatively, it is possible to make M=2, that is, there are two holding control signal terminals, and the second AND gate is an AND gate having three inputs. It is also possible to make M=3, that is, there are 3 holding control signal terminals, and the second AND gate is an AND gate having 4 inputs. And so on when M=4, 5, 6 . . . , and it will not be repeatedly described here.

In some specific implementations, in the pixel compensation circuit according to the embodiments of the present disclosure, the structure of the second AND gate may be the same as the structure of the first AND gate. Of course, the specific structure of the second AND gate can be designed according to the specific application environment, and the present disclosure is not limited to the embodiments disclosed herein. And, for the specific structure of the second AND gate, a structure known in the art or developed in the future can be applied.

In order to simplify the process and design, the scan signal of the next row may be used as the signal at the holding control signal terminal. In some specific implementations, in the pixel compensation circuit according to the embodiments of the present disclosure, the M holding control signal terminals are defined as the first to the M-th holding control signal terminals, and the signal of the m-th holding control signal terminal is a signal when the signal of the scan signal terminal corresponding to the row in which the pixel compensation circuit is located is shifted by m rows. Specifically, when M=1, the signal of the first holding control signal terminal is a signal when the signal of the scan signal terminal corresponding to the row in which the pixel compensation circuit is located is shifted by one line. Alternatively, when M=2, the signal of the first holding control signal terminal is a signal when the signal of the scan signal terminal corresponding to the row which the pixel compensation circuit is located in is shifted by one line, and the signal of the second holding control signal terminal is a signal when the signal at the scan signal terminal corresponding to the row which the pixel compensation circuit is located in is shifted by 2 lines. Alternatively, when M=3, the signal of the first holding control signal terminal is a signal when the signal of the scan signal terminal corresponding to the row which the pixel compensation circuit is located in is shifted by one line, the signal of the second holding control signal terminal is a signal when the signal at the scan signal terminal corresponding to the row which the pixel compensation circuit is located in is shifted by 2 lines, and the signal at the 3rd holding control signal terminal is a signal when the signal of the scan signal terminal corresponding to the row which the pixel compensation circuit is located in is shifted by 3 lines. And so on when M=4, 5, 6 . . . , and it will not be repeatedly described here.

Figure 2C:
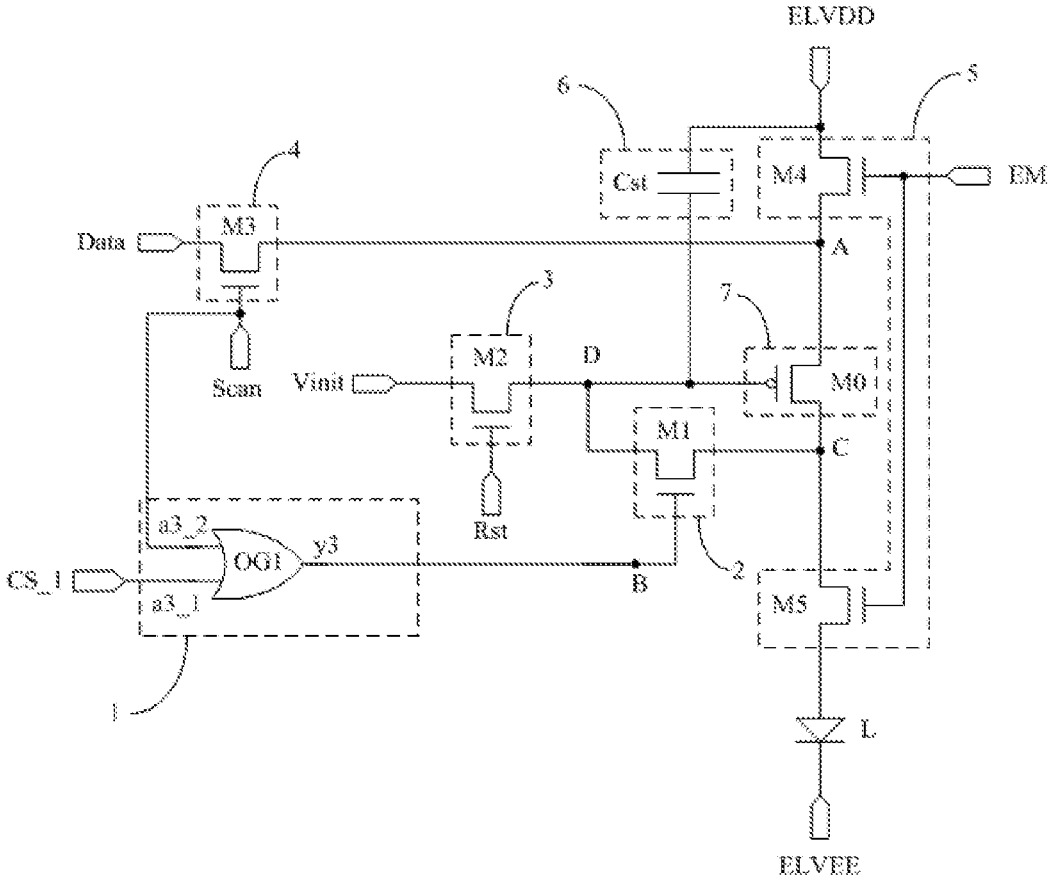
FIG. 2*c* is a further schematic structural diagram of the pixel compensation circuit shown in FIG. 1*a;*
Figure 3C:
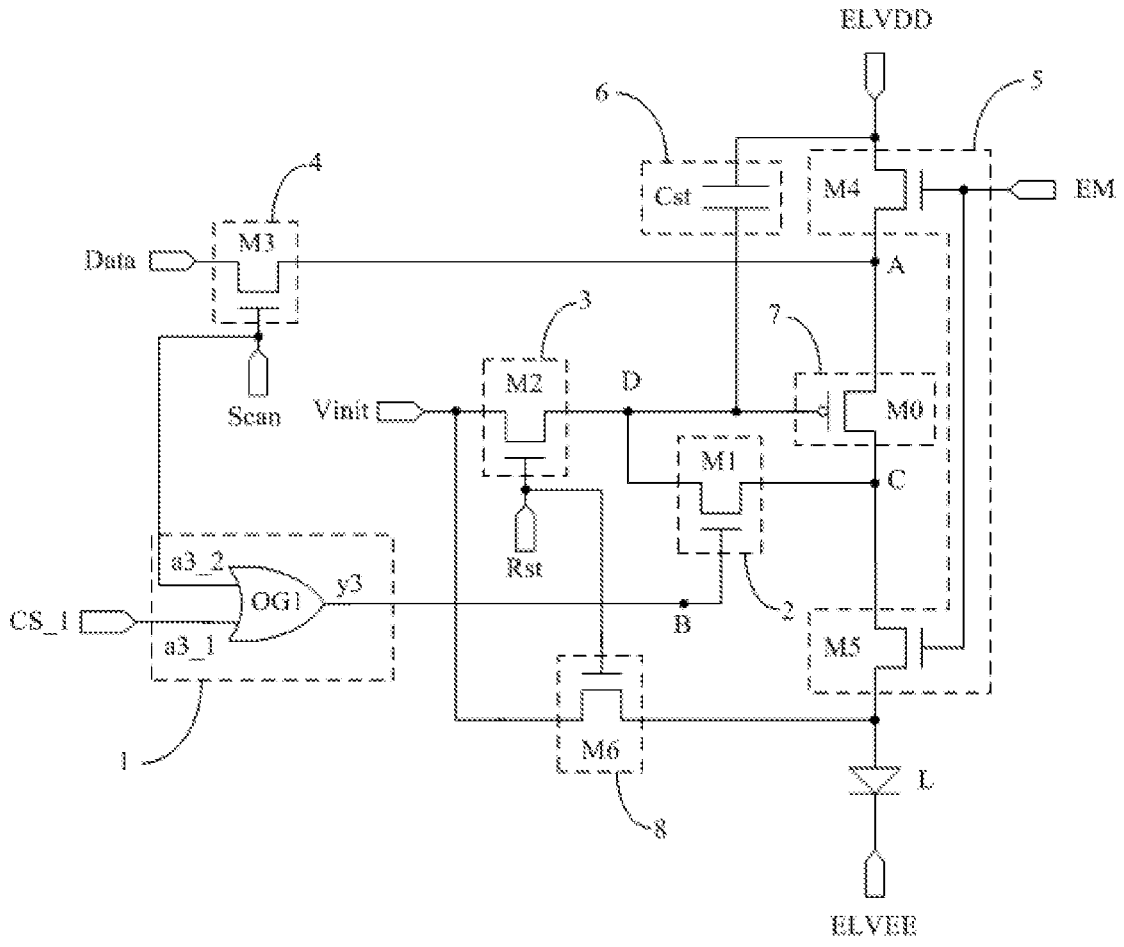
FIG. 3*c* is a further schematic structural diagram of the pixel compensation circuit shown in FIG. 1*b;*

Alternatively, in some specific implementations, in the pixel compensation circuit according to the embodiments of the present disclosure, as shown in FIG. 2*c* and FIG. 3*c* (FIG. 2*c* and FIG. 3*c* are both exemplified with M=1), the signal control module 1 may include: a first OR gate OG1 with M+1 inputs.

Each of the first to the M-th inputs a3_1 to a3_M of the first OR gate OG1 is connected to a holding control signal terminal CS_m, and the (M+1)th input terminal a3_M+1 of the first OR gate OG1 is connected to the scan signal terminal Scan, the output terminal y3 of the first OR gate OG1 is connected to the second node B. In FIG. 2*c*, the case of M=1 is illustrated as an example. FIG. 2*e* shows such a case where M is a multiple. The content described with respect to FIG. 2*c* can be applied likewise or adaptively to the embodiment shown in FIG. 2*e*.

In some specific implementations, in the pixel compensation circuit according to the embodiments of the present disclosure, the first OR gate outputs a low potential signal at the output only when the signals of the first to the (M+1)th input terminals are low potential signals. As long as the signal of one of the first to the (M+1)th inputs is a high potential signal, the output terminal outputs a high potential signal.

In some specific implementations, in the pixel compensation circuit according to the embodiments of the present disclosure, as shown in FIG. 2*c* and FIG. 3*c*, it is possible to make M=1, that is, there is one holding control signal terminal CS_1, and the first OR gate OG1 is an OR gate with two inputs a3_1 and a3_2. Alternatively, it is possible to make M=2, that is, there are 2 holding control signal terminals, and the first OR gate is an OR gate having 3 inputs. It is also possible to make M=3, that is, there are three holding control signal terminals, and the first OR gate is an OR gate having four inputs. And so on when M=4, 5, 6 . . . , and it will not be repeatedly described here.

In some specific implementations, in the pixel compensation circuit according to the embodiments of the present disclosure, the specific structure of the first OR gate can be determined according to the specific application environment, and the disclosure shall not be limited thereto. The specific structure of the first OR gate can be the same as that of the prior art, and will be readily understood by those skilled in the art, and thus further details are omitted herein from being described.

In order to simplify the process and design, the scan signal of the next row may be used as the signal at the holding control signal terminal. In some specific implementations, in the pixel compensation circuit according to the embodiments of the present disclosure, the M holding control signal terminals are defined as the first to the M-th holding control signal terminal, and the signal of the m-th holding control signal terminal is a signal when the signal of the scan signal terminal corresponding to the row which the pixel compensation circuit is located in is shifted by m rows. Specifically, when M=1, the signal of the first holding control signal terminal is a signal when the signal of the scan signal terminal corresponding to the row which the pixel compensation circuit is located in is shifted by one line. Alternatively, when M=2, the signal of the first holding control signal terminal is a signal when the signal of the scan signal terminal corresponding to the row which the pixel compensation circuit is located in is shifted by one line, and the signal of the second holding control signal terminal is a signal when the signal at the scan signal terminal corresponding to the row which the pixel compensation circuit is located in is shifted by 2 lines. Alternatively, when M=3, the signal of the first holding control signal terminal is a signal when the signal of the scan signal terminal corresponding to the row which the pixel compensation circuit is located in is shifted by one line, and the signal of the second holding control signal terminal is a signal when the signal at the scan signal terminal corresponding to the row which the pixel compensation circuit is located in is shifted by 2 lines, and the signal at the 3rd holding control signal terminal is a signal when the signal of the scan signal terminal corresponding to the row which the pixel compensation circuit is located in is shifted by 3 lines. And so on when M=4, 5, 6 . . . , and it will not be repeatedly described here.

Figure 2D:
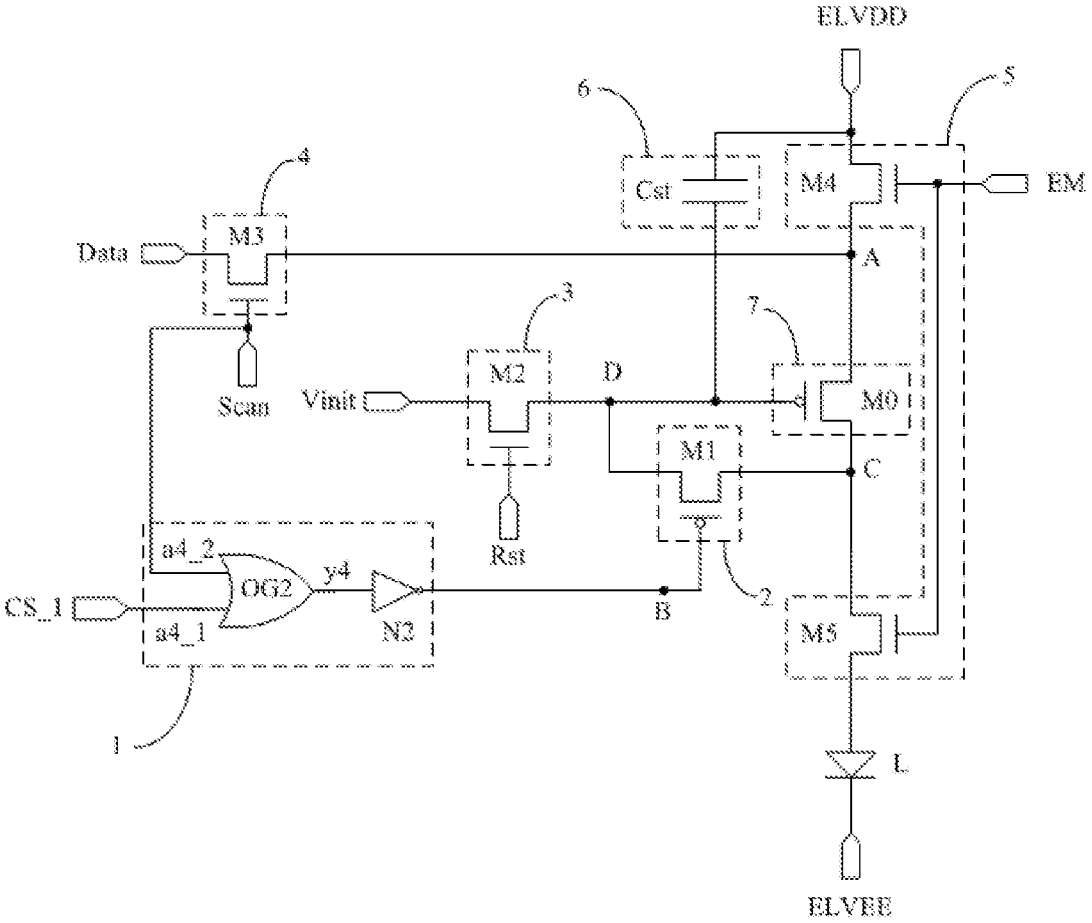
FIG. 2*d* is a still further schematic diagram of a specific structure of the pixel compensation circuit shown in FIG. 1*a;*
Figure 2E:
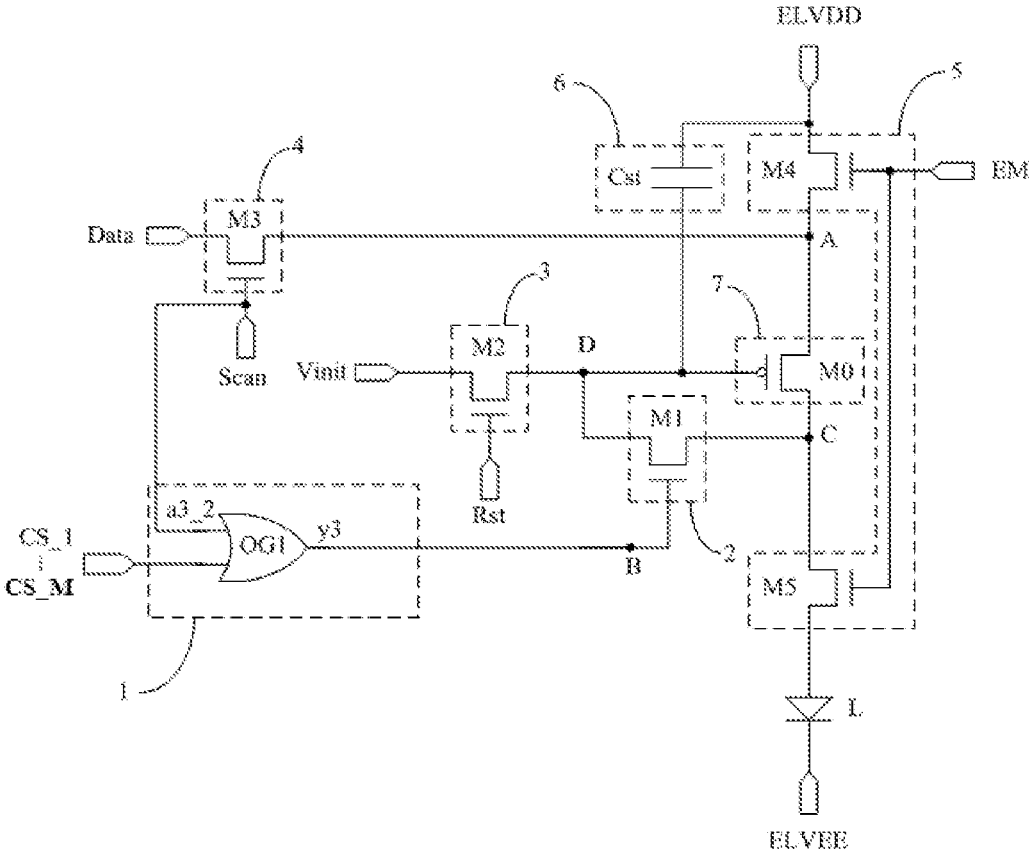
FIG. 2*e* is a schematic structural diagram of a circuit according to another embodiment of the present disclosure.
Figure 3D:
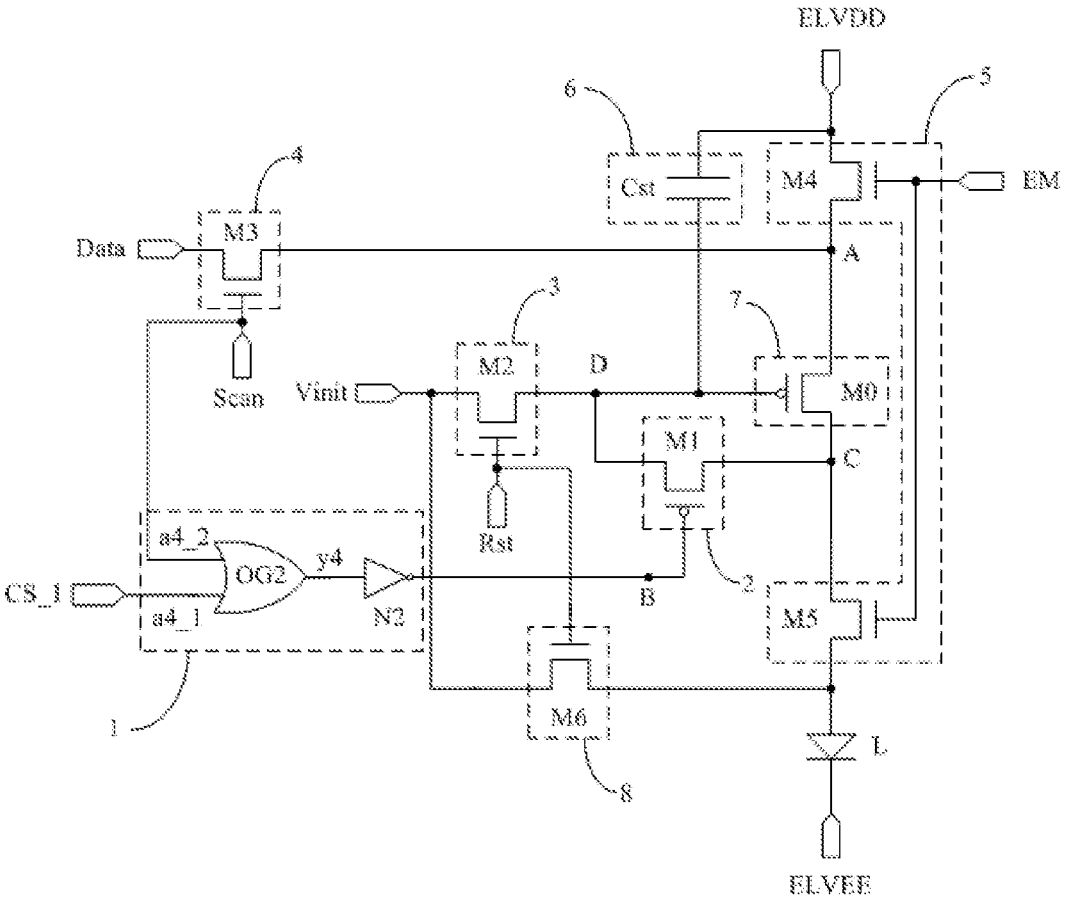
FIG. 3*d* is a still further schematic diagram of a specific structure of the pixel compensation circuit shown in FIG. 1*b;*

Alternatively, in some specific implementations, in the pixel compensation circuit according to the embodiments of the present disclosure, as shown in FIG. 2*d* and FIG. 3*d* (FIG. 2*d* and FIG. 3*d* are both exemplified with M=1), the signal control module 1 may include: a second inverter N2, and a second OR gate OG2 having M+1 inputs.

Each of the first to the M-th inputs a4_1 to a4_M of the second OR gate OG2 is connected to a respective holding control signal terminal CS_m, and the (M+1)th input terminal a4_M+1 of the second OR gate OG2 is connected to the scan signal terminal Scan, and a output terminal y4 of the second OR gate OG2 is connected to the input terminal of the second inverter N2.

The output of the second inverter N2 is connected to the second node B.

In some specific implementations, in the pixel compensation circuit according to the embodiments of the present disclosure, the second OR gate outputs a low potential signal at the output thereof only when the signals of the first to the (M+1)th input terminals are low potential signals. As long as the signal of one of the first to the (M+1)th inputs is a high potential signal, the output terminal outputs a high potential signal. The second inverter is used to make the potential of the signal at its output reversed respective to the potential of the signal at its input.

In some specific implementations, in the pixel compensation circuit according to the embodiments of the present disclosure, as shown in FIG. 2*d* and FIG. 3*d*, M=1, that is, there is one holding control signal terminal CS_1, and then the second OR gate may be an OR gate with two inputs a4_1 and a4_2. Alternatively, it is possible to make M=2, that is, there are 2 holding control signal terminals, and then the second OR gate is an OR gate having 3 inputs. It is also possible to make M=3, that is, there are 3 holding control signal terminals, and the second OR gate is an OR gate having 4 inputs. And so on when M=4, 5, 6 . . . , and it will not be repeatedly described here.

In some specific implementations, in the pixel compensation circuit according to the embodiments of the present disclosure, the structure of the second OR gate may be the same as the structure of the first OR gate. Of course, the specific structure of the second OR gate can be designed according to a specific application environment; The present disclosure is not limited thereto. The specific structure of the second or the second gate can be the same as that of the prior art, and will readily be understood by those skilled in the art, and thus further details are not described herein.

In order to simplify the process and design, the scan signal of the next row may be used as the signal of the holding control signal terminal. In some specific implementations, in the pixel compensation circuit according to the embodiments of the present disclosure, the M holding control signal terminals are defined as the first to the M-th holding control signal terminals, and the signal of the m-th holding control signal terminal is a signal when the signal of the scan signal terminal corresponding to the row which the pixel compensation circuit is located in is shifted by m rows. Specifically, when M=1, the signal of the first holding control signal terminal is a signal when the signal of the scan signal terminal corresponding to the row which the pixel compensation circuit is located in is shifted by one line. Alternatively, when M=2, the signal of the first holding control signal terminal is a signal when the signal of the scan signal terminal corresponding to the row which the pixel compensation circuit is located in is shifted by one line, and the signal of the second holding control signal terminal is a signal when the signal at the scan signal terminal corresponding to the row which the pixel compensation circuit is located in is shifted by 2 lines. Alternatively, when M=3, the signal of the first holding control signal terminal is a signal when the signal of the scan signal terminal corresponding to the row which the pixel compensation circuit is located in is shifted by one line, and the signal of the second holding control signal terminal is a signal when the signal at the scan signal terminal corresponding to the row which the pixel compensation circuit is located in is shifted by 2 lines, and the signal at the 3rd holding control signal terminal is a signal when the signal of the scan signal terminal corresponding to the row which the pixel compensation circuit is located in is shifted by 3 lines. And so on when M=4, 5, 6 . . . , and it will not be repeatedly described here.

In some specific implementations, in the pixel compensation circuit according to the embodiments of the present disclosure, as shown in FIG. 2*a* to FIG. 3*d*, the driving control module 7 may include: a driving transistor M0; wherein the driving transistor M0 has a control electrode connected to the fourth node D is, a first pole connected to the first node A, and a second pole connected to the third node C.

In some specific implementations, in the pixel compensation circuit according to the embodiments of the present disclosure, as shown in FIG. 2*a* to FIG. 3*d*, the driving transistor M0 may be a P-type transistor; wherein the control electrode of the driving transistor M0 is its gate. The first pole of the transistor M0 is its source, and the second pole of the transistor M0 is its drain. Alternatively, in some specific implementations, the driving transistor may also be an N-type transistor; wherein the control electrode of the driving transistor is its gate, the first pole of the driving transistor is its drain, and the second pole of the driving transistor is its source. In practical applications, the specific type of the driving transistor can be determined according to the actual application environment, and the disclosure is not limited thereto.

In some specific implementations, in the pixel compensation circuit according to the embodiments of the present disclosure, as shown in FIG. 2*a* to FIG. 3*d*, the compensation control module 2 may include: a first switching transistor M1; wherein, the control electrode of the first switching transistor M1 is connected to the second node B, the first pole of the first switching transistor M1 is connected to the third node C, and the second pole of the first switching transistor M1 is connected to the fourth node D.

In some specific implementations, in the pixel compensation circuit according to the embodiments of the present disclosure, as shown in FIGS. 2*a*, 2*d*, 3*a*, and 3*d*, the first switching transistor M1 may be a P-type transistor. Alternatively, as shown in FIGS. 2*b*, 2*c*, 3*b*, and 3*c*, the first switching transistor M1 may also be an N-type transistor. And the disclosure is not limited thereto.

In some specific implementations, in the pixel compensation circuit according to the embodiments of the present disclosure, when the first switching transistor is in an ON state under control of the signal of the second node, the third node and the fourth node can be connected. That is, the control electrode of the driving transistor is connected to the second pole thereof.

In some specific implementations, in the pixel compensation circuit according to the embodiments of the present disclosure, as shown in FIG. 2*a* to FIG. 3*d*, the initialization module 3 may include: a second switching transistor M2; wherein, the control electrode of the second switching transistor M2 is connected to the reset signal terminal Rst, the first pole of the second switching transistor M2 is connected to the initialization signal terminal Vinit, and the second pole of the second switching transistor M2 is connected to the fourth node D.

In some specific implementations, in the pixel compensation circuit according to the embodiments of the present disclosure, as shown in FIGS. 2*a*, 2*b*, 3*a*, and 3*b*, the second switching transistor M2 may be a P-type transistor. Alternatively, as shown in FIGS. 2*c*, 2*d*, 3*c*, and 3*d*, the second switching transistor M2 may also be an N-type transistor; and the disclosure is not limited thereto.

In some specific implementations, in the pixel compensation circuit according to the embodiments of the present disclosure, when the second switching transistor is turned on under control of the signal at the reset signal terminal, the signal of the initialization signal terminal can be provided to the fourth node to initialize the control electrode of the drive transistor.

In some specific implementations, in the pixel compensation circuit according to the embodiments of the present disclosure, as shown in FIG. 2*a* to FIG. 3*d*, the data writing module 4 may include: a third switching transistor M3; wherein, the control electrode of the third switching transistor M3 is connected to the scan signal terminal Scan, the first pole of the third switching transistor M3 is connected to the data signal terminal Data, and the second pole of the third switching transistor M3 is connected to the first node A.

In some specific implementations, in the pixel compensation circuit according to the embodiments of the present disclosure, as shown in FIGS. 2*a*, 2*b*, 3*a*, and 3*b*, the third switching transistor M3 may be a P-type transistor. Alternatively, as shown in FIGS. 2*c*, 2*d*, 3*c*, and 3*d*, the third switching transistor M3 may be an N-type transistor; and the disclosure is not limited thereto.

In some specific implementations, in the pixel compensation circuit according to the embodiments of the present disclosure, when the third switching transistor is turned on under control of the signal at the scan signal terminal, the signal of the data signal terminal can be provided to the first node.

In some specific implementations, in the pixel compensation circuit according to the embodiments of the present disclosure, as shown in FIG. 2*a* to FIG. 3*d*, the light emission control module 5 may include: a fourth switching transistor M4 and a fifth switching transistor M5; wherein the control electrode of the fourth switching transistor M4 is connected to the light-emission control signal terminal EM, the first pole of the fourth switching transistor M4 is connected to the first power terminal ELVDD, and the second pole of the fourth switching transistor M4 is connected to the first node A.

The control electrode of the fifth switching transistor M5 is connected to the light-emission control signal terminal EM, the first pole of the fifth switching transistor M5 is connected to the third node C, and the second pole of the fifth switching transistor M5 is connected to the first end of the light emitting device L.

In some specific implementations, in the pixel compensation circuit according to the embodiments of the present disclosure, as shown in FIG. 2*a*, FIG. 2*b*, FIG. 3*a*, and FIG. 3*b*, the fourth switching transistor M4 and the fifth switching transistor M5 may be P-type transistors. Alternatively, as shown in FIGS. 2*c*, 2*d*, 3*c*, and 3*d*, the fourth switching transistor M4 and the fifth switching transistor M5 may be N-type transistors; and the disclosure is not limited thereto.

In some specific implementations, in the pixel compensation circuit according to the embodiments of the present disclosure, when the fourth switching transistor is turned on under control of the signal of the light-emission control signal terminal, the signal of the first power terminal can be provided to the first node. When the fifth switching transistor is turned on under control of the signal of the light-emission control signal terminal, the signal of the third node can be provided to the first end of the light emitting device, that is, the operate current generated by the driving transistor for driving the light emitting device to emit light is applied to the light emitting device so that the driving transistor drives the light emitting device to emit light.

In some specific implementations, in the pixel compensation circuit according to the embodiments of the present disclosure, as shown in FIG. 3*a* to FIG. 3*d*, the anode reset module 8 may include: a sixth switching transistor M6; wherein, the control electrode of the sixth switching transistor M6 is connected to the reset signal terminal Rst, the first pole of the sixth switching transistor M6 is connected to the initialization signal terminal Vinit, and the second pole of the sixth switching transistor M6 is connected to the first end of the light emitting device L.

In some specific implementations, in the pixel compensation circuit according to the embodiments of the present disclosure, as shown in FIGS. 2*a*, 2*b*, 3*a*, and 3*b*, the sixth switching transistor M6 may be a P-type transistor. Alternatively, as shown in FIGS. 2*c*, 2*d*, 3*c*, and 3*d*, the sixth switching transistor M6 may be an N-type transistor. And the present disclosure is not limited thereto.

In some specific implementations, in the pixel compensation circuit according to the embodiments of the present disclosure, when the sixth switching transistor is turned on under control of the signal at the reset signal terminal, the signal of the initialization signal terminal may be provided to the first end of the light emitting device to reset the light-emitting device so as to avoid interference between the light emittings of adjacent frames.

In some specific implementations, in the pixel compensation circuit according to the embodiments of the present disclosure, as shown in FIG. 2*a* to FIG. 3*d*, the storage module 6 may include: a storage capacitor Cst; wherein the first end of the storage capacitor Cst is connected to the fourth node D, and the second end of the storage capacitor Cst is connected to the first power terminal ELVDD.

In some specific implementations, in the pixel compensation circuit according to the embodiments of the present disclosure, the storage capacitor may be charged or discharged under control of the signals of the first power terminal and the fourth node, and when the fourth node is in a floating state, due to the bootstrap action of the storage capacitor, the voltage difference between the two ends thereof can be kept stable, that is, the voltage difference between the first power terminal and the fourth node can be kept stable.

The foregoing is only for exemplifying some specific structures of the modules in the pixel compensation circuit according to the embodiments of the present disclosure. In some specific implementations, the specific structures of the modules are not limited to the above-mentioned structures according to the embodiment of the present disclosure, and the present disclosure is not limited thereto. Other structures known to the skilled person in the field may also be applied.

Further, in order to unify the preparation processes, in some specific implementations, in the above pixel compensation circuit according to the embodiments of the present disclosure, as shown in FIG. 3*a*, the first to sixth switching transistors M1 to M6 may all be P-type transistors. Alternatively, as shown in FIG. 3*c*, the first to sixth switching transistors M1 to M6 may also all be N-type transistors. The present disclosure is not limited thereto.

In some specific implementations, in the pixel compensation circuit according to the embodiments of the present disclosure, generally, the P-type transistor is turned off under the action of the high-potential gate signal, and is turned on under the action of the low-potential gate signal; the N-type transistor is turned on under the action of the high-potential gate signal and turned off under the action of the low-potential gate signal.

It should be noted that, in the above pixel compensation circuit according to the embodiments of the present disclosure, the transistors may be thin film transistors (TFT) or metal oxide semiconductor field effect transistor (MOS, Metal-Oxide-Semiconductor); however, the present disclosure shall not be limited thereto. In some specific implementations, the control electrodes of the transistors are gates, and the first poles thereof can be used as sources and the second poles can be used as drains, or vice versa, according to the types of the transistors and the signals at the signal terminals. The present disclosure is not limited thereto. In the specific embodiments as above, the description is made and exemplified with MOS transistors.

The operation process of the above pixel compensation circuits according to the embodiments of the present disclosure will be described below in conjunction with the circuit timing diagram. In the following description, a high potential signal is indicated by 1, and a low potential signal is indicated by 0. It should be noted that "1"s and "0"s are used to indicate logic potentials, only for better explaining the specific operation process of the embodiments of the present disclosure, and are not intended to indicate the specific potentials applied to the control electrodes of the respective switching transistors in the specific implementations.

Embodiment 1

Figure 4A:
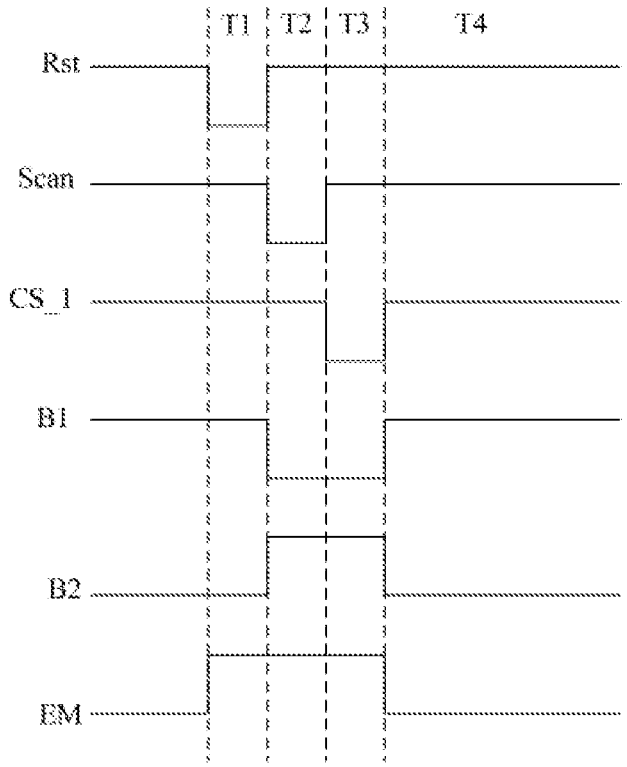
FIG. 4*a* is a timing diagram for Embodiment 1 and Embodiment 2.

Taking the structure of the pixel compensation circuit shown in FIG. 3*a* as an example, the corresponding input timing diagram is shown in FIG. 4*a*. Specifically, four stages, the initialization phase T1, the data writing phase T2, the compensation holding phase T3, and the light emitting phase T4, are illustrated in the input timing chart shown in FIG. 4*a*. The compensation holding phase T3 includes one compensation holding sub-phase. B1 represents the signal of the second node B.

In the initialization phase T1, Rst=0, Scan=1, CS 1=1, and EM=1. Since Rst=0, both the second switching transistor M2 and the sixth switching transistor M6 are turned on. The turned-on second switching transistor M2 supplies the signal of the initialization signal terminal Vinit to the fourth node D, that is, the control electrode of the driving transistor M0, to initialize the control electrode of the driving transistor M0. At this time, the voltage of the control electrode of the driving transistor M0 is the voltage $V_{init}$ of the signal of the initialization signal terminal $V_{init}$. The turned-on sixth switching transistor M6 supplies a signal of the initialization signal terminal $V_{init}$ to the first end of the light emitting device L to reset the light emitting device L. Since Scan=1, the third switching transistor M3 is turned off. Since EM=1, both the fourth switching transistor M4 and the fifth switching transistor M5 are turned off. Since CS 1=1 and Scan=1, the first AND gate AG1 outputs a high potential signal to the second node B to control the first switching transistor M1 to be turned off.

In the data writing phase T2, Rst=1, Scan=0, CS 1=1, and EM=1. Since EM=1, both the fourth switching transistor M4 and the fifth switching transistor M5 are turned off. Since Rst=1, both the second switching transistor M2 and the sixth switching transistor M6 are turned off. Since Scan=0, the third switching transistor M3 is turned on and supplies the data signal of the data signal terminal Data to the first node A, so that the voltage of the first node A is the voltage $V_{data}$ of the data signal. Since Scan=0 and CS 1=1, the first AND gate AG1 outputs a low potential signal to the second node B to control the first switching transistor M1 to be turned on. The turned-on first switching transistor M1 connects the control electrode of the driving transistor M0 and the second pole thereof, so that the driving transistor M0 is in a diode-connected state, thus the voltage $V_{data}$ input to the first node A charges the storage capacitor Cst via the driving transistor M0.

In the compensation holding sub-phase of the compensation holding phase T3, Rst=1, Scan=1, CS 1=0, and EM=1. Since EM=1, both the fourth switching transistor M4 and the fifth switching transistor M5 are turned off. Since Rst=1, both the second switching transistor M2 and the sixth switching transistor M6 are turned off. Since Scan=1, the third switching transistor M3 is turned off. Since Scan=1 and CS 1=0, the first AND gate AG1 outputs a low potential signal to the second node B to control the first switching transistor M1 to continue to be turned on. The turned-on first switching transistor M1 connects the control electrode of the driving transistor M0 and the second pole thereof, so that the driving transistor M0 is in a diode-connected state, thus the voltage $V_{data}$ input to the first node A continues to charge the storage capacitor Cst through the driving transistor M0 until the voltage of the fourth node D becomes: $V_{data}-|V_{th}|$, and $V_{th}$ is the threshold voltage of the driving transistor M0. The voltage of the fourth node D is kept stable by the storage capacitor Cst.

In the light emitting phase T4, Rst=1, Scan=1, CS 1=1, and EM=0. Since Rst=1, both the second switching transistor M2 and the sixth switching transistor M6 are turned off. Since Scan=1, the third switching transistor M3 is turned off. Since Scan=1 and CS 1=1, the first AND gate AG1 outputs a high potential signal to the second node B to control the first switching transistor M1 to be turned off. Since EM=0, both the fourth switching transistor M4 and the fifth switching transistor M5 are turned on. The turned-on fourth switching transistor M4 supplies the signal of the first power terminal ELVDD to the first node A, so that the voltage of the first node A becomes the voltage $V_{dd}$ of the signal of the first power terminal ELVDD, that is, the voltage of the first pole of the driving transistor M0 becomes $V_{dd}$. The voltage of the fourth node D is maintained as: $V_{data}-|V_{th}|$ due to the effect of the storage capacitor Cst. According to the saturation state current characteristic of the driving transistor M0, the operating current $I_L$ flowing through the driving transistor M0 and used to drive the light emitting device L to emit light satisfies the following formula:

$$I_L=K[V_{sg}-|V_{th}|]^2=K[V_{dd}-V_{data}+|V_{th}|-|V_{th}|]^2=K[V_{dd}-V_{data}]^2,$$

wherein $V_{sg}$ represents the source-gate voltage of the driving transistor M0;

$$K=\frac{1}{2}\mu\mathrm{Cox}\frac{W}{L},$$

where L represents the length of the channel of the driving transistor M0, W represents the width of the channel of the driving transistor M0, Cox represents the capacitance per unit area of the gate insulating layer of the driving transistor M0, and μ represents the mobility of the driving transistor M0 (these parameters are structural parameters and their values are relatively stable in the same structures and can be counted as constants). It can be seen from the operating current $I_L$ formula that the operating current $I_L$ outputted by the driving transistor M0 for driving the light-emitting device L to emit light is only related to the voltage $V_{dd}$ of the first power terminal ELVDD and the voltage $V_{data}$ of the data signal terminal Data, and regardless of the threshold voltage $V_{th}$ of the driving transistor M0. Thus, the problem of the threshold voltage $V_{th}$ drift due to the process of the driving transistor M0 and the long-time operation can be solved.

In the pixel compensation circuit of the first embodiment, the first AND gate AG1 is provided so that the control electrode of the driving transistor M0 and the second pole can be connected in the data writing phase T2 and the compensation holding phase T3, so that the voltage at the first node A charges the fourth node D through the driving transistor M0 to completely write $V_{th}$ to the fourth node D. Therefore, compared with the conventional solution in which $V_{th}$ is written only in the data writing phase T2, since the $V_{th}$ is written not only in the data writing phase T2 but also continuously written in the compensation holding phase T3 before the light emitting phase T4. The $V_{th}$ compensation time is extended to make the $V_{th}$ compensation more sufficient, and thus when the pixel compensation circuit according to the embodiments of the present disclosure is applied to the display panel, especially when applied to a display panel with a high refresh rate, the image display performance of the display panel can be improved.

Embodiment 2

Taking the structure of the pixel compensation circuit shown in FIG. 3*b* as an example, the corresponding input timing chart is shown in FIG. 4*a*. Specifically, four phases of the initialization phase T1, the data writing phase T2, the compensation holding phase T3, and the light emitting phase T4 are illustrated in the input timing chart shown in FIG. 4*a*. The compensation holding phase T3 includes one compensation holding sub-phase. B2 represents the signal of the second node B.

In the initialization phase T1, Rst=0, Scan=1, CS_1=1, and EM=1. Since Rst=0, both the second switching transistor M2 and the sixth switching transistor M6 are turned on. The turned-on second switching transistor M2 supplies the signal of the initialization signal terminal Vinit to the fourth node D, that is, the control electrode of the driving transistor M0, to initialize the control electrode of the driving transistor M0. At this time, the voltage of the gate of the driving transistor M0 becomes the voltage $V_{init}$ of the signal at the initialization signal terminal Vinit. The turned-on sixth switching transistor M6 supplies a signal of the initialization signal terminal Vinit to the first end of the light emitting device L to reset the light emitting device L. Since Scan=1, the third switching transistor M3 is turned off. Since EM=1, both the fourth switching transistor M4 and the fifth switching transistor M5 are turned off. Since CS_1=1 and Scan=1, the second AND gate AG2 outputs a high potential signal to the first inverter N1, so that the first inverter N1 outputs a low potential signal to the second node B to control the first switching transistor M1 to be turned off.

In the data writing phase T2, Rst=1, Scan=0, CS_1=1, and EM=1. Since EM=1, both the fourth switching transistor M4 and the fifth switching transistor M5 are turned off. Since Rst=1, both the second switching transistor M2 and the sixth switching transistor M6 are turned off. Since Scan=0, the third switching transistor M3 is turned on and supplies the data signal at the data signal terminal Data to the first node A, so that the voltage of the first node A becomes the voltage $V_{data}$ of the data signal. Since Scan=0 and CS_1=1, the second AND gate AG2 outputs a low potential signal to the first inverter N1, so that the first inverter N1 outputs a high potential signal to the second node B to control the first switching transistor M1 to be turned on. The turned-on first switching transistor M1 connects the control electrode of the driving transistor M0 and the second pole thereof, so that the driving transistor M0 is in a diode-connected state, thus the voltage $V_{data}$ input to the first node A charges the storage capacitor Cst through the driving transistor M0.

In the compensation holding sub-phase of the compensation holding phase T3, Rst=1, Scan=1, CS_1=0, and EM=1. Since EM=1, both the fourth switching transistor M4 and the fifth switching transistor M5 are turned off. Since Rst=1, both the second switching transistor M2 and the sixth switching transistor M6 are turned off. Since Scan=1, the third switching transistor M3 is turned off. Since Scan=1 and CS_1=0, the second AND gate AG2 outputs a low potential signal to the first inverter N1, so that the first inverter N1 outputs a high potential signal to the second node B to control the first switching transistor M1 to continue to be conductive. The turned-on first switching transistor M1 connects the control electrode of the driving transistor M0 and the second pole thereof, so that the driving transistor M0 is in a diode-connected state, so that the voltage $V_{data}$ input to the first node A continues to charge the storage capacitor Cst through the driving transistor M0 until the voltage of the fourth node D becomes: $V_{data}-|V_{th}|$, and $V_{th}$ is the threshold voltage of the driving transistor M0. The voltage of the fourth node D is kept stable by the storage capacitor Cst.

In the light emitting phase T4, Rst=1, Scan=1, CS_1=1, and EM=0. Since Rst=1, both the second switching transistor M2 and the sixth switching transistor M6 are turned off. Since Scan=1, the third switching transistor M3 is turned off. Since Scan=1 and CS_1=1, the second AND gate AG2 outputs a high potential signal to the first inverter N1, so that the first inverter N1 outputs a low potential signal to the second node B to control the first switching transistor M1 to be turned off. Since EM=0, both the fourth switching transistor M4 and the fifth switching transistor M5 are turned on. The turned-on fourth switching transistor M4 supplies the signal of the first power terminal ELVDD to the first node A, so that the voltage of the first node A becomes the voltage $V_{dd}$ of the signal of the first power terminal ELVDD, that is, the voltage of the first pole of the driving transistor M0 becomes $V_{dd}$. The voltage of the fourth node D is maintained at: $V_{data}-|V_{th}|$ due to the effect of the storage capacitor Cst. According to the saturation state current characteristic of the driving transistor M0, the operating current $I_L$ flowing through the driving transistor M0 to drive the light emitting device L to emit light satisfies the following formula:

$$I_L=K[V_{sg}-|V_{th}|]^2=K[V_{dd}-V_{data}+|V_{th}|-|V_{th}|]^2=K[V_{dd}-V_{data}]^2,$$

wherein, $V_{sg}$ represents the source-gate voltage of the driving transistor M0;

$$K=\frac{1}{2}\mu\mathrm{Cox}\frac{W}{L},$$

where L represents the length of the channel of the driving transistor M0, W represents the width of the channel of the driving transistor M0, Cox represents the capacitance per unit area of the gate insulating layer of the driving transistor M0, and μ represents the mobility of the driving transistor M0 (these parameters are structural parameters, and the values thereof are relatively stable in the same structures and can be counted as constants). It can be seen from the operating current $I_L$ formula that the operating current $I_L$ outputted by the driving transistor M0 for driving the light-emitting device L to emit light is only related to the voltage $V_{dd}$ of the first power terminal ELVDD and the voltage $V_{data}$ of the data signal terminal Data, and regardless of the threshold voltage $V_{th}$ of the driving transistor M0. Thus, the problem of the threshold voltage $V_{th}$ drifting due to the process of the driving transistor M0 and the long-time operation can be solved.

In the pixel compensation circuit of the second embodiment, the control electrode and the second pole of the driving transistor M0 can be connected in both the data writing phase T2 and the compensation holding phase T3 by the second AND gate AG2 and the first inverter N1. Thus, the voltage of the first node A charges the fourth node D through the driving transistor M0 to completely write $V_{th}$ to the fourth node D. Therefore, compared with the conventional solution in which $V_{th}$ is written only in the data writing phase T2, since the $V_{th}$ is written not only in the data writing phase T2, but also continuously written in the compensation holding phase T3 before the light emitting phase T4, the $V_{th}$ compensation time is extended to make the $V_{th}$ compensation more sufficient. And, when the pixel compensation circuit according to the embodiments of the present disclosure is applied to the display panel, especially when applied to a display panel with a high refresh rate, the image display performance of the display panel can be improved.

Embodiment 3

Figure 4B:
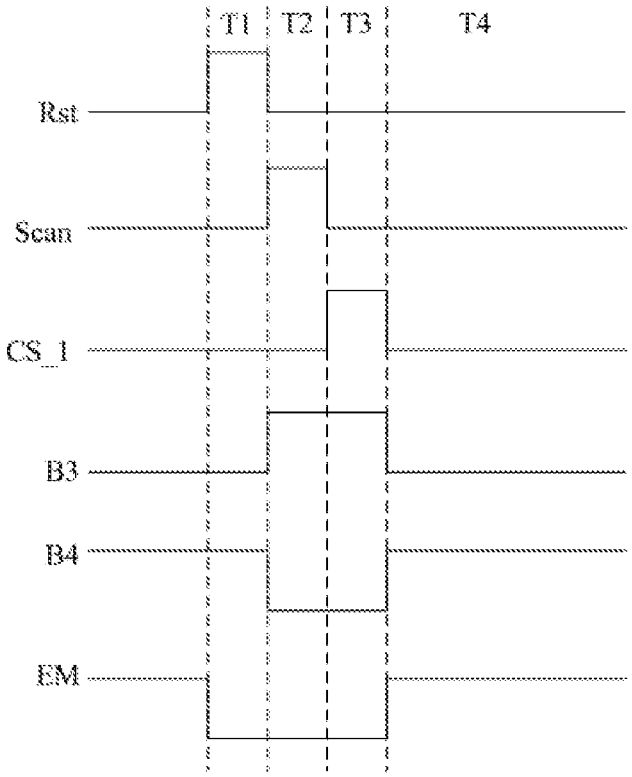
FIG. 4*b* is a timing diagram for Embodiment 3 and Embodiment 4.

Taking the structure of the pixel compensation circuit shown in FIG. 3*c* as an example, the corresponding input timing chart is shown in FIG. 4*b*. Specifically, four stages of the initialization phase T1, the data writing phase T2, the compensation holding phase T3, and the light emitting phase T4 are illustrated in the input timing chart shown in FIG. 4*b*. The compensation holding phase T3 includes one compensation holding sub-phase. B3 represents the signal of the second node B.

In the initialization phase T1, Rst=1, Scan=0, CS_1=0, and EM=0. Since Rst=1, both the second switching transistor M2 and the sixth switching transistor M6 are turned on. The turned-on second switching transistor M2 supplies the signal of the initialization signal terminal $V_{init}$ to the fourth node D, that is, the control electrode of the driving transistor M0, to initialize the control electrode of the driving transistor M0 At this time, the voltage of the control electrode of the driving transistor M0 is the voltage $V_{init}$ of the signal of the initialization signal terminal Vinit. The turned-on sixth switching transistor M6 supplies a signal of the initialization signal terminal Vinit to the first end of the light emitting device L to reset the light emitting device L. Since Scan=0, the third switching transistor M3 is turned off. Since EM=0, both the fourth switching transistor M4 and the fifth switching transistor M5 are turned off. Since CS_1=0 and Scan=0, the first OR gate OG1 outputs a low potential signal to the second node B to control the first switching transistor M1 to be turned off.

In the data writing phase T2, Rst=0, Scan=1, CS_1=0, and EM=0. Since EM=0, both the fourth switching transistor M4 and the fifth switching transistor M5 are turned off. Since Rst=0, both the second switching transistor M2 and the sixth switching transistor M6 are turned off. Since Scan=1, the third switching transistor M3 is turned on and supplies the data signal of the data signal terminal Data to the first node A, so that the voltage of the first node A becomes the voltage $V_{data}$ of the data signal. Since Scan=1 and CS_1=0, the first OR gate OG1 outputs a high potential signal to the second node B to control the first switching transistor M1 to be turned on. The turned-on first switching transistor M1 connects the control electrode of the driving transistor M0 and the second pole thereof, so that the driving transistor M0 is in a diode-connected state, thus the voltage $V_{data}$ input to the first node A charges the storage capacitor Cst through the driving transistor M0.

In the compensation holding sub-phase of the compensation holding phase T3, Rst=0, Scan=0, CS_1=1, EM=0. Since EM=0, both the fourth switching transistor M4 and the fifth switching transistor M5 are turned off. Since Rst=0, both the second switching transistor M2 and the sixth switching transistor M6 are turned off. Since Scan=0, the third switching transistor M3 is turned off. Since Scan=0 and CS_1=1, the first OR gate OG1 outputs a high potential signal to the second node B to control the first switching transistor M1 to continue to be turned on. The turned-on first switching transistor M1 connects the control electrode of the driving transistor M0 and the second pole thereof, so that the driving transistor M0 is in a diode-connected state, thus the voltage $V_{data}$ input to the first node A continues to charge the storage capacitor Cst through the driving transistor M0 until the voltage of the fourth node D becomes: $V_{data}-|V_{th}|$, and $V_{th}$ is the threshold voltage of the driving transistor M0. The voltage of the fourth node D is kept stable by the storage capacitor Cst.

In the light-emitting phase T4, Rst=0, Scan=0, CS_1=0, and EM=1. Since Rst=0, both the second switching transistor M2 and the sixth switching transistor M6 are turned off. Since Scan=0, the third switching transistor M3 is turned off. Since Scan=0 and CS_1=0, the first OR gate OG1 outputs a low potential signal to the second node B to control the first switching transistor M1 to be turned off. Since EM=1, both the fourth switching transistor M4 and the fifth switching transistor M5 are turned on. The turned-on fourth switching transistor M4 supplies the signal of the first power terminal ELVDD to the first node A, so that the voltage of the first node A becomes the voltage $V_{dd}$ of the signal of the first power terminal ELVDD, that is, the voltage of the first pole of the driving transistor M0 becomes $V_{dd}$. The voltage of the fourth node D is maintained as: $V_{data}|V_{th}|$ due to the effect of the storage capacitor Cst. According to the saturation state current characteristic of the driving transistor M0, the operating current $I_L$ flowing through the driving transistor M0 to drive the light emitting device L to emit light satisfies the following formula:

$$I_L=K[V_{sg}-|V_{th}|]^2=K[V_{dd}-V_{data}+|V_{th}|-|V_{th}|]^2=K[V_{dd}-V_{data}]^2,$$

where Vsg represents the source-gate voltage of the driving transistor M0;

$$K=\frac{1}{2}\mu\mathrm{Cox}\frac{W}{L},$$

L represents the length of the channel of the driving transistor M0, W represents the width of the channel of the driving transistor M0, Cox represents the capacitance per unit area of the gate insulating layer of the driving transistor M0, and μ represents the mobility of the driving transistor M0 (these are structural parameters, and the values thereof are relatively stable in the same structures and can be counted as constants). It can be seen from the operating current $I_L$ formula that the operating current $I_L$ outputted by the driving transistor M0 for driving the light-emitting device L to emit light is only related to the voltage $V_{dd}$ of the first power terminal ELVDD and the voltage $V_{data}$ of the data signal terminal Data, and regardless of the threshold voltage $V_{th}$ of the driving transistor M0. The problem of the threshold voltage $V_{th}$ drifting due to the process of the driving transistor M0 and the long-time operation can be solved.

In the pixel compensation circuit of the third embodiment, the control electrode and the second pole of the driving transistor M0 can be connected in the data writing phase T2 and the compensation holding phase T3 by providing the first OR gate OG1, so that the voltage of the first node A charges the fourth node D through the driving transistor M0 to completely write $V_{th}$ to the fourth node D. Therefore, compared with the conventional solution in which $V_{th}$ is written only in the data writing phase T2, since the $V_{th}$ is written not only in the data writing phase T2, but also continuously written in the compensation holding phase T3 before the light emitting phase T4, the $V_{th}$ compensation time is extended to make the $V_{th}$ compensation more sufficient. When the pixel compensation circuit according to the embodiments of the present disclosure is applied to the display panel, especially when applied to a display panel with a high refresh rate, and the image display performance of the display panel can be improved.

Embodiment 4

Taking the structure of the pixel compensation circuit shown in FIG. 3*d* as an example, the corresponding input timing chart is shown in FIG. 4*b*. Specifically, four stages of the initialization phase T1, the data writing phase T2, the compensation holding phase T3, and the light emitting phase T4 are illustrated in the input timing chart shown in FIG. 4*b*. The compensation holding phase T3 includes one compensation holding sub-phase. B4 represents the signal of the second node B.

In the initialization phase T1, Rst=1, Scan=0, CS_1=0, and EM=0. Since Rst=1, both the second switching transistor M2 and the sixth switching transistor M6 are turned on. The turned-on second switching transistor M2 supplies the signal of the initialization signal terminal $V_{init}$ to the fourth node D, that is, the control electrode of the driving transistor M0, to initialize the control electrode of the driving transistor M0. At this time, the voltage of the control electrode of the driving transistor M0 is the voltage $V_{init}$ of the signal of the initialization signal terminal $V_{init}$. The turned-on sixth switching transistor M6 supplies the signal of the initialization signal terminal $V_{init}$ to the first end of the light emitting device L to reset the light emitting device L. Since Scan=0, the third switching transistor M3 is turned off. Since EM=0, both the fourth switching transistor M4 and the fifth switching transistor M5 are turned off. Since CS_1=0 and Scan=0, the second OR gate OG2 outputs a low potential signal to the second inverter N2, so that the second inverter outputs a high potential signal to the second node B to control the first switching transistor M1 to be turned off.

In the data writing phase T2, Rst=0, Scan=1, CS_1=0, and EM=0. Since EM=0, both the fourth switching transistor M4 and the fifth switching transistor M5 are turned off. Since Rst=0, both the second switching transistor M2 and the sixth switching transistor M6 are turned off. Since Scan=1, the third switching transistor M3 is turned on and supplies the data signal of the data signal terminal Data to the first node A, so that the voltage of the first node A becomes the voltage $V_{data}$ of the data signal. Since Scan=1 and CS_1=0, the second OR gate OG2 outputs a high potential signal to the second inverter N2, so that the second inverter outputs a low potential signal to the second node B to control the first switching transistor M1 to be turned on. The turned-on first switching transistor M1 connects the control electrode of the driving transistor M0 and the second pole thereof, so that the driving transistor M0 is in a diode-connected state, thus the voltage $V_{data}$ input to the first node A charges the storage capacitor Cst through the driving transistor M0.

In the compensation holding sub-phase of the compensation holding phase T3, Rst=0, Scan=0, CS_1=1, EM=0. Since EM=0, both the fourth switching transistor M4 and the fifth switching transistor M5 are turned off. Since Rst=0, both the second switching transistor M2 and the sixth switching transistor M6 are turned off. Since Scan=0, the third switching transistor M3 is turned off. Since Scan=0 and CS_1=1, the second OR gate OG2 outputs a high potential signal to the second inverter N2, so that the second inverter outputs a low potential signal to the second node B to control the first switching transistor M1 to continue to be conductive. The turned-on first switching transistor M1 connects the control electrode of the driving transistor M0 and the second pole thereof, so that the driving transistor M0 is in a diode-connected state, thus the voltage $V_{data}$ input to the first node A continues to charge the storage capacitor Cst through the driving transistor M0 until the voltage of the fourth node D becomes: $V_{data}-|V_{th}|$, and $V_{th}$ is the threshold voltage of the driving transistor M0. The voltage of the fourth node D is kept stable by the storage capacitor Cst.

In the light-emitting phase T4, Rst=0, Scan=0, CS_1=0, and EM=1. Since Rst=0, both the second switching transistor M2 and the sixth switching transistor M6 are turned off. Since Scan=0, the third switching transistor M3 is turned off.

Since Scan=0 and CS_1=0, the second OR gate OG2 outputs a low potential signal to the second inverter N2, so that the second inverter outputs a high potential signal to the second node B to control the first switching transistor M1 to be turned off. Since EM=1, both the fourth switching transistor M4 and the fifth switching transistor M5 are turned on. The turned-on fourth switching transistor M4 supplies the signal of the first power terminal ELVDD to the first node A, so that the voltage of the first node A becomes the voltage $V_{dd}$ of the signal of the first power terminal ELVDD, that is, the voltage of the first pole of the driving transistor M0 becomes $V_{dd}$. The voltage of the fourth node D is maintained as: $V_{data}-|V_{th}|$ due to the effect of the storage capacitor Cst. According to the saturation state current characteristic of the driving transistor M0, the operating current $I_L$ flowing through the driving transistor M0 to drive the light emitting device L to emit light satisfies the following formula:

$$I_L=K[V_{sg}-|V_{th}|]^2=K[V_{dd}-V_{data}+|V_{th}|-|V_{th}|]^2=K[V_{dd}-V_{data}]^2,$$

where Vsg represents the source-gate voltage of the driving transistor M0;

$$K=\frac{1}{2}\mu\mathrm{Cox}\frac{W}{L},$$

L represents the length of the channel of the driving transistor M0, W represents the width of the channel of the driving transistor M0, Cox represents the capacitance per unit area of the gate insulating layer of the driving transistor M0, and μ represents the mobility of the driving transistor M0 (these are structural parameters, and their values are relatively stable in the same structures and can be counted as constants). It can be seen from the operating current $I_L$ formula that the operating current $I_L$ outputted by the driving transistor M0 for driving the light-emitting device L to emit light is only related to the voltage $V_{dd}$ of the first power terminal ELVDD and the voltage $V_{data}$ of the data signal terminal Data, and regardless of the threshold voltage $V_{th}$ of the driving transistor M0. The problem of the threshold voltage $V_{th}$ drifting due to the process of the driving transistor M0 and the long-time operation can be solved.

In the pixel compensation circuit of the fourth embodiment, the control electrode and the second pole of the driving transistor M0 can be connected in both the data writing phase T2 and the compensation holding phase T3 by providing the second OR gate OG2 and the second inverter N2, so that the voltage of the first node A charges the fourth node D through the driving transistor M0 to completely write $V_{th}$ to the fourth node D. Therefore, compared with conventional solution in which $V_{th}$ is written only in the data writing phase T2, since the $V_{th}$ is written not only in the data writing phase T2 but also continuously written in the compensation holding phase T3 before the light emitting phase T4, the $V_{th}$ compensation time is extended to make the $V_{th}$ compensation more sufficient. When the pixel compensation circuit according to the embodiments of the present disclosure is applied to the display panel, especially when applied to a display panel with a high refresh rate, the image display performance of the display panel can be improved.

Figure 6:
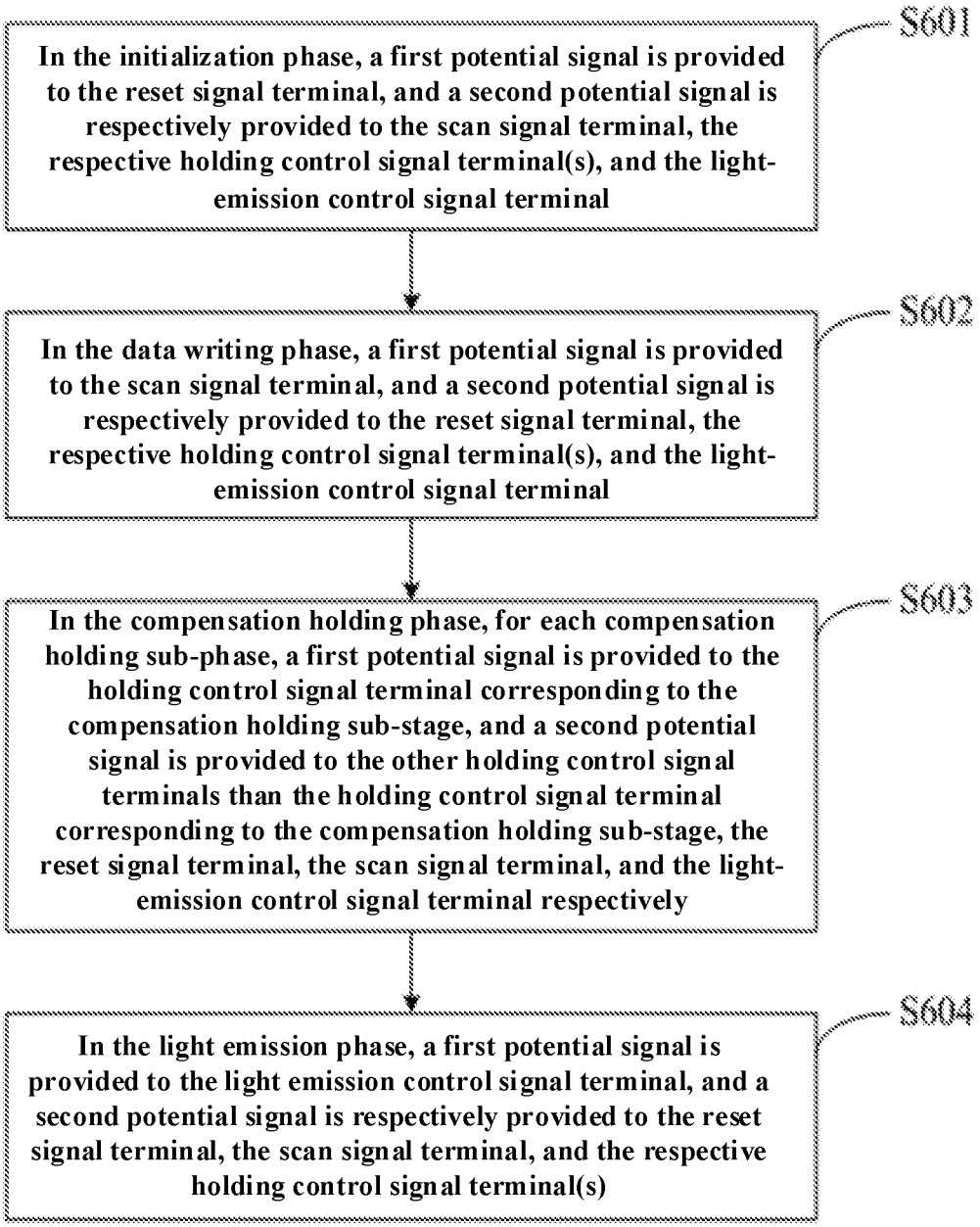
FIG. 6 is a flowchart of a driving method according to an embodiment of the present disclosure.

The embodiment of the present disclosure further provides a driving method of the pixel compensation circuits according to the embodiments of the present disclosure. As shown in FIG. 6, the method includes: an initialization phase, a data writing phase, a compensation holding phase, and a light emitting phase; The compensation hold phase includes compensation holding sub-phase(s) corresponding to the respective holding control signal terminal(s).

Step S601: In the initialization phase, a first potential signal is provided to the reset signal terminal, and a second potential signal is respectively provided to the scan signal terminal, the respective holding control signal terminal(s), and the light-emission control signal terminal.

Step S602: In the data writing phase, a first potential signal is provided to the scan signal terminal, and a second potential signal is respectively provided to the reset signal terminal, the respective holding control signal terminal(s), and the light-emission control signal terminal.

Step S603: In the compensation holding phase, for each compensation holding sub-phase, a first potential signal is provided to the holding control signal terminal corresponding to the compensation holding sub-stage, and a second potential signal is provided to the other holding control signal terminals than the holding control signal terminal corresponding to the compensation holding sub-stage, the reset signal terminal, the scan signal terminal, and the light-emission control signal terminal respectively.

Step S604: In the light emission phase, a first potential signal is provided to the light emission control signal terminal, and a second potential signal is respectively provided to the reset signal terminal, the scan signal terminal, and the respective holding control signal terminal(s).

The above-mentioned driving method according to the embodiment of the present disclosure can improve the time for the threshold voltage compensation of the driving transistor, and make the threshold voltage compensation more sufficient. Thus, when the pixel compensation circuit according to the embodiments of the present disclosure is applied to the display panel with high refresh frequency, the image display quality can be improved.

In some specific implementations, in the driving method according to the embodiment of the present disclosure, the first potential signal may be a high potential signal, and correspondingly, the second potential signal is a low potential signal. Alternatively, the first potential signal may be a low potential signal, and correspondingly, the second potential signal is a high potential signal. This can be determined depending on whether the switching transistor in the pixel compensation circuit is an N-type transistor or a P-type transistor. The present disclosure is not limited thereto.

According to an embodiment of the present disclosure, there also provides a display panel including the circuit according to any of the embodiments of the present disclosure.

In some specific implementations, the above display panel according to the embodiment of the present disclosure may be an organic light emitting display panel.

Figure 7:
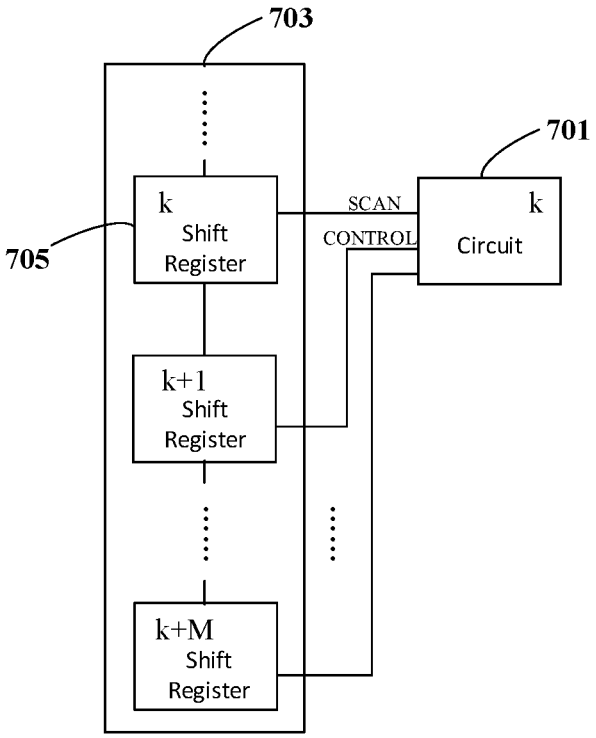
FIG. 7 is a schematic structural diagram of a circuit in accordance with an embodiment of the present disclosure.

In some specific implementations, in the display panel a gate drive circuit can be employed to output a scan signal. In some specific implementations, the display panel may further include: a gate driving circuit comprising cascaded (K+M) stages of shift registers; wherein K is a total number of rows of pixels in the display panel. FIG. 7 illustrates a structural diagram of a circuit in a display panel according to an embodiment of the present disclosure.

A circuit 701 and a gate drive circuit 703 in the k-th row are schematically shown in FIG. 7. The circuit 701 can be a circuit for pixel compensation in accordance with any of the above-mentioned embodiments. The gate drive circuit 703 can include K+M stages of shift registers which are cascaded. The shift registers k-th to (k+M)th associated with the circuit 701 in the k-th row are schematically shown in FIG. Here, k is an integer greater than or equal to 1 and less than or equal to K.

The scan signal terminal (SCAN) of the pixel compensation circuit in the k-th row is connected to the signal output terminal of the k-th stage shift register. And the holding control signal terminals (CONTROL) of the pixel compensation circuit in the k-th row are connected to the signal output terminals of the (k+1)th to (k+M)th stage shift registers in a one-to-one manner.

In some specific implementations, M=1. In such a case, the display panel includes: a gate driving circuit comprising cascaded K+1 stages of shift registers; wherein, the scan signal terminal of the pixel compensation circuit in the k-th row is connected to the signal output terminal of the k-th stage shift register, and the holding control signal terminal of the pixel compensation circuit in the k-th row is correspondingly connected to the signal output terminal of the (k+1)th stage shift register. Alternatively, it is also possible to make M=2. In such a case, the display panel includes: a gate driving circuit comprising cascaded K+2 stages of shift registers; wherein, the scan signal terminal of the pixel compensation circuit in the k-th row is connected to the signal output terminal of the k-th stage shift register, and one of the holding control signal terminals of the pixel compensation circuit in the k-th row is connected to the signal output terminal of the (k+1)th stage shift register, and the other holding control signal terminal is connected to the signal output terminals of the (k+2)th stage shift register. Alternatively, it is also possible to make M=3. In such a case, the display panel includes: a gate driving circuit comprising cascaded K+3 stages of shift registers; wherein, the scan signal terminal of the pixel compensation circuit in the k-th row is connected to the signal output terminal of the k-th stage shift register, the first holding control signal terminal of the pixel compensation circuit in the k-th row is connected to the signal output terminal of the (k+1)th stage shift register, the second holding control signal terminal thereof is connected to the signal output terminal of the (k+2)th stage shift register, and the third holding control signal terminal thereof is connected to the signal output terminal of the (k+3)th stage shift register. And so on when M=4, 5, 6 . . . , and it will not be repeatedly described here.

The specific structure of the shift register may employ a structure known in the art or developed in the future, which is thus not described herein in detail and shall not be construed as limiting the present disclosure. In practical applications, the (K+1)th to (K+M)th stages of shift registers may be not used to input signals to the scan signal terminals in the pixel compensation circuit of the display panel, instead they can be used only for inputting signals to the holding control signal terminals. Of course, the specific settings of the (K+1)th to (K+M)th stages of shift registers can be determined according to the actual application environment.

According to an embodiment of the present disclosure, there further provides a display device including the above display panel according to the embodiments of the present disclosure. The display device may comprise any product or component having display function, such as mobile phone, tablet computer, television, display, notebook computer, digital photo frame, navigator, and the like. For the other components of the display device, those known in the art can be employed, and thus will not be described in further detail herein.

The pixel compensation circuits, the driving methods thereof, the display panels and the display devices according to the embodiments of the present disclosure may include: a signal control module, a compensation control module, an initialization module, a data writing module, a light emission control module, a storage module, a drive control module, and a light-emitting device; wherein the data writing module is configured to provide the signal of the data signal terminal to the first node under control of the signal of the scan signal terminal; the signal control module is configured to combine the signal of the scan signal terminal with the signal of the respective holding control signal terminal(s) and provide the combined signal to the second node; the compensation control module is configured to connect the third node and the fourth node under control of the signal of the second node; the initialization module is configured to provide the signal of the initialization signal terminal to the fourth node under control of the signal of the reset signal terminal; the driving control module is configured to be turned on under control of the signals of the first node and the fourth node; the storage module is configured to maintain the voltage of the fourth node stable; and the light emission control module is configured to cause the drive control module to drive the light emitting device to emit light, under control of the signal of the light-emission control signal terminal.

According to various embodiments of the present disclosure, the time for threshold voltage compensation for the driving transistor can be increased to make the threshold voltage compensation more sufficient, so that the image display quality can be improved, particularly when they are applied to a display panel having a high refresh rate.

It will be apparent to those skilled in the art that various modifications and variations can be made in the present disclosure without departing from the spirit and scope of the present disclosure. Thus, those modifications and variations that fall within the scope of the claims of the present application and the equivalent thereof are intended to be embraced by the present invention.

What is claimed is:

1. A circuit comprising:

a light emitting device;

a first node, a second node, a third node, and a fourth node;

a data writing circuit;

a signal control circuit;

a compensation control circuit comprising a first transistor;

an initialization circuit comprising a second transistor; and a drive control circuit comprising a drive transistor, wherein:

the data writing circuit comprises a third transistor having a control terminal connected to a first signal terminal, a first terminal connected to a data signal terminal, a second terminal connected to the first node, and conducting a signal at the data signal terminal to the first node under control of a signal at the first signal terminal;

the signal control circuit comprises a logic gate having a first input terminal connected to the first signal terminal, second input terminals respectively connected to second signal terminals, an output terminal connected to the second node, and providing a control signal through the output terminal to the second node based on the signal at the first signal terminal and the signals at the respective second signal terminals;

the first transistor of the compensation control circuit has a control terminal connected to the second node, a first terminal connected to the third node, and a second terminal connected to the fourth node, and is adaptable for connecting the third node and the fourth node under control of the signal at the second node;

the second transistor of the initialization circuit has a control terminal connected to a reset signal terminal, a first terminal connected to an initialization signal terminal, a second terminal connected to the fourth node, and is adaptable conducting a signal at the initialization signal terminal to the fourth node under control of a signal of the reset signal terminal; and the driving transistor of the drive control circuit has a control terminal connected to the fourth node, a first terminal connected to the first node, a second terminal connected to the third node, and connecting the first node and the third node under control of signals at the first node and the fourth node, to drive the light emitting device, wherein the signal at the respective second signal terminals is a holding control signal.

2. The circuit of claim 1 further comprising:

a storage capacitor connected between the fourth node and a first power terminal, for storing charges therein.

3. The circuit of claim 1, further comprising:

a light emission control circuit comprising a fourth transistor and a fifth transistor, wherein a control electrode of the fourth transistor is connected to a light-emission control signal terminal, a first pole of the fourth transistor is connected to a first power terminal, and a second pole of the fourth transistor is connected to the first node, wherein a control electrode of the fifth transistor is connected to the light emitting control signal terminal, a first pole of the fifth transistor is connected to the third node, and the second pole of the fifth transistor is connected to a first end of the light emitting device, and wherein the light emission control circuit is adaptable to allow the drive control circuit to drive the light emitting device to emit light, under control of a signal at the light-emission control signal terminal.

4. The circuit of claim 1, wherein the signal control circuit comprises:

a first OR gate having M+1 input terminals;

wherein each of the first to the M-th input terminals of the first OR gate is connected to one of the holding control signal terminals, and the (M+1)th input terminal of the first OR gate is connected to the scan signal terminal, and wherein an output terminal of the first OR gate is connected to the second node.

5. The circuit of claim 1, wherein the circuit further comprises:

an anode reset circuit comprising a sixth transistor having a control terminal connected to the reset signal terminal, a first terminal connected to the initialization signal terminal, and a second terminal connected to the first end of the light emitting device, wherein the anode reset circuit is adaptable to reset the first end of the light emitting device under control of the reset signal terminal.

6. The circuit of claim 1, wherein the holding control signal is a scan signal for a next row.

7. A circuit comprising:

a signal control circuit;

a compensation control circuit comprising a first transistor;

an initialization circuit comprising a second transistor;

a data writing circuit comprising a third transistor;

a storage circuit comprising a storage capacitor;

a drive control circuit comprising a drive transistor;

a light emitting device; and first through fourth nodes, wherein the third transistor has a control terminal connected to a scan signal terminal, a first terminal connected to a data signal terminal, a second terminal connected to a first node; and the data writing circuit is adaptable to provide a signal at the data signal terminal to the first node under control of the scan signal terminal, wherein the signal control circuit comprises a logic gate having a first input terminal connected to the scan signal terminal, M second input terminals respectively connected to M holding control signal terminals, an output terminal connected to a second node, and the signal control circuit is adaptable to provide a control signal to the second node according to a signal at the scan signal terminal and signals at the holding control signal terminals, and wherein M is a positive integer, wherein the first transistor has a control terminal connected to the second node, first terminal connected to a third node, a second terminal connected to a fourth node, and the compensation control circuit is adaptable to connect the third node and the fourth node under control of a signal at the second node, wherein the second transistor has a control terminal connected to a reset signal terminal, a first terminal connected to an initialization signal terminal, a second terminal connected to the fourth node, and the initialization circuit is adaptable to provide a signal at the initialization signal terminal to the fourth node under control of a signal of the reset signal terminal, wherein the drive transistor has a control terminal connected to the fourth node, a first terminal connected to the first node, a second terminal connected to the third node, and the drive control circuit is adaptable to connect the first node and the third node, under control of signals at the first node and the fourth node, to drive the light emitting device, and wherein the storage capacitor is connected between the fourth node and a first power terminal for maintaining a voltage at the fourth node stable.

8. The circuit of claim 7 further comprising:

a light emission control circuit comprising a fourth transistor and a fifth transistor, wherein a control electrode of the fourth transistor is connected to a light-emission control signal terminal, a first pole of the fourth transistor is connected to the first power terminal, and a second pole of the fourth transistor is connected to the first node, wherein a control electrode of the fifth transistor is connected to the light-emission control signal terminal, a first pole of the fifth transistor is connected to the third node, and a second pole of the fifth transistor is connected to the first end of the light-emitting device and, wherein the light emission control circuit is adaptable to allow the drive control circuit to drive the light emitting device to emit light, under control of the light-emission control signal terminal.

9. The circuit of claim 8, wherein the circuit further comprises:

an anode reset circuit comprising a sixth transistor having a control terminal connected to the reset signal terminal, a first terminal connected to the initialization signal terminal, and a second terminal connected to the first end of the light emitting device, wherein the anode reset circuit is adaptable to reset the first end of the light emitting device under control of the reset signal terminal.

10. The circuit of claim 7, wherein the signal control circuit comprises:

a first AND gate having M+1 input terminals;

wherein each of the first to the M-th input terminals of the first AND gate is connected to one of the holding control signal terminals, and the (M+1)th input terminal of the first AND gate is connected to the scan signal terminal, and wherein an output terminal of the first AND gate is connected to the second node.

11. The circuit of claim 7, wherein the signal control circuit comprises:

a first inverter; and a second AND gate having M+1 input terminals, wherein each of the first to the M-th input terminals of the second AND gate is connected to one of the holding control signal terminals, and the (M+1)th input terminal of the second AND gate is connected to the scan signal terminal, and an output terminal of the second AND gate is connected to an input terminal of the first inverter; and wherein an output terminal of the first inverter is connected to the second node.

12. The circuit of claim 7, wherein the signal control circuit comprises:

a second inverter; and a second OR gate having M+1 input terminals, wherein each of the first to the M-th input terminals of the second OR gate is connected to one of the holding control signal terminals, and the (M+1)th input terminal of the second OR gate is connected to the scan signal terminal, and an output terminal of the second OR gate is connected to an input terminal of the second inverter; and wherein an output terminal of the second inverter is connected to the second node.

13. A display panel comprising the circuit of claim 7.

14. The display panel of claim 13, wherein the display panel further comprises:

a gate driving circuit comprising (K+M) stages of shift registers which are cascaded; wherein K is a total number of lines of pixels in the display panel;

wherein the scan signal terminal of the circuit in the k-th line is connected to the signal output terminal of the k-th stage shift register, and each of the holding control signal terminals of the circuit in the k-th line is connected to respective one of the signal output terminals of the (k+1)th to (k+M)th stages of shift registers in one-to-one manner; wherein k is an integer greater than or equal to 1 and less than or equal to K.

15. A display device comprising the display panel of claim 13.

16. A method of driving a circuit of claim 7, comprising:

an initialization phase, a data writing phase, a compensation holding phase, and a light emitting phase, wherein the compensation holding phase comprises compensation holding sub-phases corresponding to the respective holding control signal terminals in one-to-one manner;

wherein:

in the initialization phase, a first potential signal is provided to the reset signal terminal, and a second potential signal is respectively provided to the scan signal terminal, the holding control signal terminals, and the light-emission control signal terminal;

in the data writing phase, a first potential signal is provided to the scan signal terminal, and a second potential signal is respectively provided to the reset signal terminal, the holding control signal terminals, and the light-emission control signal terminal;

in the compensation holding phase, for each of the compensation holding sub-phases, a first potential signal is supplied to the holding control signal terminal corresponding to the compensation holding sub-stage, and a second potential signal is respectively provided to the other holding control signal terminals than the one corresponding to the compensation holding sub-phase, the reset signal terminal, the scan signal terminal, and the light-emission control signal terminal; and in the light emitting phase, a first potential signal is provided to the light-emission control signal terminal, and a second potential signal is respectively provided to the reset signal terminal, the scan signal terminal, and the holding control signal terminals.

17. The circuit of claim 7, wherein the signals at the holding control signal terminals are scan signals for next M rows, and wherein M is the number of the holding control signal terminals.

* * * * *